US005892360A

United States Patent [19]

Willer et al.

[11] Patent Number: 5,892,360

[45] Date of Patent: Apr. 6, 1999

[54] PROBE CARRIER FOR DETECTING MINES OR OTHER FOREIGN OBJECTS WHICH ARE CLOSE TO THE GROUND SURFACE

[75] Inventors: Johann W. Willer, Neu-Ulm; Martin Förster, Pfullingen, both of Germany

[73] Assignee: Institut Dr. Forster Prufgeratebau GmbH & Co. KG, Reutlingen, Germany

[21] Appl. No.: 734,328

[22] Filed: Oct. 21, 1996

[30] Foreign Application Priority Data

| | | | |
|---|---|---|---|
| Oct. 21, 1995 | [DE] | Germany | 195 40 961.2 |
| May 14, 1996 | [DE] | Germany | 296 08 667.3 |

[51] Int. Cl.[6] ..... G01V 3/165; G01V 3/11; G01V 3/15; F41H 11/12

[52] U.S. Cl. ..... 324/326; 89/1.13; 324/345; 324/365

[58] Field of Search ..... 324/67, 326–329, 324/337, 345, 348–350, 357, 365; 89/1.13

[56] References Cited

U.S. PATENT DOCUMENTS

| | | | |
|---|---|---|---|
| 2,885,633 | 5/1959 | Cook | 324/357 |
| 3,634,753 | 1/1972 | Unterberger | 324/337 |
| 4,021,725 | 5/1977 | Kirkland . | |
| 4,773,298 | 9/1988 | Tischer et al. . | |
| 5,321,361 | 6/1994 | Goodman | 324/326 |
| 5,654,637 | 8/1997 | McNeill | 324/329 |

FOREIGN PATENT DOCUMENTS

| | | | |
|---|---|---|---|
| 0 040 988 | 12/1981 | European Pat. Off. . | |
| 51.551 | 2/1943 | France . | |
| 38 26 731 | 2/1990 | Germany . | |
| 39 28 082 | 3/1990 | Germany . | |
| 42 42 541 | 6/1994 | Germany . | |
| 44 43 856 | 3/1996 | Germany . | |
| 195 02 455 | 8/1996 | Germany . | |
| 1443925 | 7/1976 | United Kingdom | 324/329 |

OTHER PUBLICATIONS

*Vallon GmbH,* "Multisensor Vehicle MSV 5 for detection of UXOs", Jul. 1994, 4 pages.

*Internationale Wehrrevue,* "Das EOD–Fahrzeug Wheelbarrow Mk8", Dec. 1987, p. 1647.

*Internationale Wehrrevue,* Dec. 1987, p. 1680.

*Soldat Und Technik,* Jan. 1992, p. 81.

Patent Abstracts of Japan, JP 4–273090 (A), P–1483, Feb. 8, 1993, vol. 17, No. 62.

*Primary Examiner*—Gerard Strecker

*Attorney, Agent, or Firm*—Alston & Bird LLP

[57] ABSTRACT

A probe carrying vehicle is described which has at least one probe carrier which preferably carries at least one eddy current probe and at least one magnetic field probe for ground and foreign matter detection in a search area. Spacing means which may be in the form of a bogie assembly with wheels or chains or the like are provided to maintain a spacing between the ground and the probes. The probe carrier is movable over the search area by means of a craft, to which the probe carrier is flexibly coupled by means of coupling means. The coupling means are disposed on one end of a preferably long pole, the other end of the pole being fixed rigidly to the probe carrier. The pole ensures a proper orientation of the probe relative to the ground particularly on uneven ground.

51 Claims, 13 Drawing Sheets

PROBE CARRIER FOR DETECTING MINES OR OTHER FOREIGN OBJECTS WHICH ARE CLOSE TO THE GROUND SURFACE

BACKGROUND OF THE INVENTION

The present invention relates to a probe carrier for detecting foreign objects close to the ground surface, particularly for detecting mines and unexploded shells.

The ground area close to the surface is in many locations highly contaminated with foreign objects due to industrialization and military activity. For example, throughout the world large areas are contaminated with mines, unexploded shells and other war material and consequently such areas are unusable due to the risk for life and limb of humans and animals. Equally problematical is the contamination of military training areas by fragments, projectiles, etc. The detection and subsequent clearance of these and similar scrap and junk items are of great significance.

For the detection of electrically conductive and in particular metal scrap, which cannot be directly detected by humans because they are in the ground, use is frequently made of inductive probes operating according to the eddy current principle. It is also known to carry out by means of magnetic field probes searches for magnetizable ferromagnetic materials, particularly being magnetizable by the earth's magnetic field. Apart from personnel and cost intensive, as well as hazardous manual searching by the probe-using teams, where the land makes this possible, use is also made of portable probe carriers, which generally carry several probes and allow a more rational search. DE 44 43 856 describes a portable or travelling probe carrier, which is pulled by means of a cable or chain by a land vehicle and also has a driving seat adaptable to the slope or gradient. It is considered advantageous in this method that the probe carrier hanging on the cable or chain is otherwise freely mobile and can largely freely follow the surface relief of the ground. However, particularly in the case of probes with a pronounced directional characteristic, with such a probe carrier it is difficult to associate the search signals detected by the probes with a specific location in the search area.

DESCRIPTION OF THE PRIOR ART

DE-A-38 26 731, DE-A-39 28 082 and U.S. Pat. No. 4,021,725 disclose devices, which carry in front of them on cantilever arms a probe carrier. It is not possible to reliably maintain either the orientation or the spacing from the ground surface. In impassable land areas a collision between the probe carrier and the ground is unavoidable if the vehicle "pitches" due to ground unevennesses.

DE-A-42 42 541 relates to a search device, in which a daughter vehicle with a cantilever arm is controlled by a mother vehicle by means of a supply line or a radio path. The probe carrier is here again installed on a cantilever arm. Basically the same problems as described hereinbefore arise.

The technical problem of the invention is to create a device with which one or more probes can be so guided that they are always oriented in a substantially optimum manner with respect to the search area, so that the search signals emitted by the probes can be associated with greater accuracy with the actual location of a search object in the search area.

SUMMARY OF THE INVENTION

The above and other objects and advantages of the present invention are achieved by the provision of a probe carrying vehicle which includes at least one probe carrier which mounts at least one probe for ground and foreign matter detection in the search area, and a long pole rigidly connected to the probe carrier at least with respect to a horizontal axis. The pole includes coupling means at the end remote from the probe carrier for flexible coupling of the carrier to a pulling or pushing craft.

As a result of the arrangement according to the invention the movement freedom of the probe carrier is advantageously restricted. The connection between the probe holder and the pole, which is rigid at least with respect to a horizontal axis, ensures that tilting movements of the probe carrier in the movement direction are only possible by relatively small angles. The tilt axis is transferred into the end area of the pole adjacent the pulling or pushing craft to which it is coupled. The tilt angle thus becomes substantially independent of the ground unevennesses in the vicinity of the probe carrier and is largely determined by changes to the height difference between said probe carrier and the coupling point to the craft. The longer the pole section connected to the probe carrier and which is in itself immobile, the less absolute height difference changes are rendered noticeable as a tilt of the probe carrier. The pole length is a function of the overall size of the probe carrying vehicle, as well as the use purpose and terrain. A pole length of 4 to 10 meters, preferably roughly 7 meters, or roughly 1.4 to 4 times the horizontal dimensions of the probe carrier leads to the desired results.

This also ensures a large constancy of the orientation of the probes relative to the search area. This is particularly advantageous for probes with a pronounced directional characteristic. Particularly in the case of the latter significant location errors could occur, if the probe arrived in a very marked inclined position, which is possible with the prior art probe carrier.

The long pole also allows an advantageous large distance between the probes and the towing craft or vehicle, whose metallic parts, particularly if moved relative to the probes, could act as jammers. Despite the advantageous large space between the preferably manned craft and the probe carrier, there is still a good controllability of the probe carrier with high curve precision and track trueness.

The probe carrier can be towed by a towing craft or vehicle. This is the preferred movement mode, particularly when seeking non-explosive foreign bodies. The pole may then be designated as a drawbar. However, it is also possible when towing to provide safety at least with respect to not particularly active mines, such as e.g. personnel mines, which could be blown up by the probe carrier. For example, the probe mounting means may be designed as a bogie assembly and the bogie assembly could be adjustable in its direction of travel. Thus, the direction of travel given by the bogie could be set at an angle to the pole extension, so that the probe carrier is towed in a track positioned laterally with respect to the towing vehicle. In this case the towing vehicle can travel on already searched, safe ground and can constantly extend the same, e.g. by spirally encircling a hazardous area.

However, the bogie assembly could also be steerable and preferably the steering is operable from the craft. This can take place by cable lines or other means, such as e.g. hydraulic or pneumatic control means. In this case when towing it is possible to pass round obstacles without the craft having to leave the search track.

The probe carrying vehicle according to the invention makes it possible, unlike in the case of the hitherto known probe carriers, for the probe carrier to be advanced in front of the vehicle. This can e.g. be advantageous if explosive objects are included among the search objects. Particularly in such a case the long pole offers an additional safety gain for the person operating in the craft. The steering can be particularly advantageously used in that the probe carrier can be steered e.g. in front of a vehicle travelling along a road and which is searching the track to be subsequently travelled over by the vehicle, e.g. the towing vehicle of a convoy. The steerability ensures that even relatively narrow search tracks (roads) can be travelled over without particular driving skill on the part of the main vehicle and in particular without leaving the searched track.

It is particularly advantageous if the pole is bendable horizontally, i.e. about a vertical axis, so as to e.g. be able to travel in serpentines. This is advantageously possible if it comprises an open-link chain, which is admittedly vertically rigid, but allows lateral deflections. Such open-link chains can also comprise box-like links, which are interconnected by vertical pivot pins. They ensure that although the action of the rigid pole is maintained, in that it maintains the vertical orientation of the probes, deflections are rendered possible when necessary, e.g. on passing round a rocky outcrop or the like. It is also ensured that the pole, which is also usually the carrier of the supply lines, etc., does not drag on the ground.

In particularly advantageous manner the lateral flexibility can be introduced and removed from the vehicle, e.g. by introducing into the open-link chain a flexible hose or tube, which can be inflated in order to make said chain into a rigid pole and which allows the flexibility again after letting out the air.

It is also possible to tow the probe carrier by means of a helicopter or a watercraft, e.g. when searching flooded areas. Also in the case of shallower waters, in which a search for ammunition and the like is particularly difficult, searching can take place with said probe carrier. It is necessary for the probe carrier not only to be located at the front or back, but also below the pulling or pushing craft, e.g. a boat. In order to maintain probe orientation, the pole, e.g. by a parallelogram guidance with two pole like elements, can always be kept in a desired orientation.

The position of the surface to be searched, i.e. the ocean bed, can be determined as a function of the desired criteria. If it is intended that the probe carrier floats above the ocean bed, then the probe carrier, which can advantageously contain a floodable and preferably compressed air-reflating floating body, can be controlled or regulated by a depth control dependent on said buoyancy equilibrium and/or by a hydrodynamic depth control, e.g. by winglike diving rudders. This control can be influenced by a depth or spacing measurement, e.g. an echo depth finder. However, as here also use is preferably made of a probe carrier with a bogie assembly, the probe carrier can also roll on the ocean bed or can be pulled in sledge-like manner. This also helps if as a result of sudden unevennesses, also in the case of a floating control there is a collision with the ocean bed.

Through the filling of the flood tank on the probe carrier with air, the latter, e.g. at the end of the work, rises to the surface and can be taken up again by the watercraft. It is advantageous for the pole, on the ship side to engage on a preferably floatable base element to be fitted to the watercraft. Then, it forms besides the probe carrier a second "buoy", which holds the other end of the pole on the surface and consequently permits easy salvage. This base element can also contain the control and supply means, as well as the measuring means, e.g. for the depth measurement by means of an echo depth finder and/or angular measurement on the pole, so that together with the probe carrier and the pole it forms a functional unit, which only requires an output connection for display and recording equipment.

The pole can connect the probe carrier and craft on a substantially straight line. With respect to a straight connecting line between the coupling means and the probe carrier, advantageously the pole generally has an upwardly diverging shape. As a result of an upward pole curvature, it is possible to prevent that in particular when cornering obstacles close to the ground such as bushes or larger rocks, can prevent a lateral movement of the pole.

The pole may be one single rod or the like, or may be constructed as a pair of rods which may be interconnected by other rods or the like to increase stiffness of the pole. Stiffness of the pole is essential especially for long poles to prevent the pole from bending. Bending or swinging of the pole might occur particularly on uneven ground with obstacles and might result in a jerky motion of the probe carrier which in turn could make interpretation of signals provided by the probes more difficult. In a preferred embodiment the pole is a framework construction with at least three non-coplaner rods or the like connected preferably rigidly on one side to the coupling means and on the other side to the probe carrier. The joining points between the rods and the probe carrier may be chosen to distribute stress and forces in a desired advantageous manner. Preferably the rods of the framework construction are arranged in such a way so as to define the edges of a pyramid with at least three edges, with the coupling means disposed on the tip side of the pyramid and the probe carrier disposed on the bottom side of the pyramid where the rods are further apart from each other. In case of a probe carrier with a large width traversly to the moving direction a pole with four rods connecting the coupling means and the probe carrier in the framework construction may be used. The rods may be arranged in two pairs of rods, each pair being connected to one side end portion of the wide probe carrier. The rods of a pair are close together on the side of the coupling means and have a vertical spacing corresponding to about the height of the body of the probe carrier on the side of the probe carrier. A pole comprising a framework construction of preferably interconnected rods rigidly connected to the coupling means and the probe carrier can help to improve the rigidity of the entire probe carrier-pole construction.

The rods of the framework construction may be constructed from rod segments detachably connected e.g. in a coaxial manner to each other. The rods may also be detachably mounted to each other in order to make it possible to take apart the entire framework construction e.g. for transportation. For example, the rods may be separately detachable from the coupling means and/or the probe carrier. The longitudinal rods may, for example, be divided into two segments of about the same length. By using detachable rod segments the length of the pole may be advantageously adapted to the purpose and environment of a particular search task.

The rods and/or rod segments may be made of light weight material which is preferably electrically non-conductive, like plastic material. The material can be fibre-reinforced. The rods or rod segments are preferably in the form of hollow tubes. A pole construction in this framework manner facilitates the maneuvering of the probe carrier when the probe carrier is towed by the craft or when it precedes the craft and is pushed by the craft, or in intermediate situations e.g. in curves. The craft may be manned or unmanned.

Although the pole can be constructed in one piece, it advantageously has at least two detachably interconnected and preferably torsionally stable pole segments, which can be curved, but are preferably straight. The construction of the pole from pole segments makes it possible to lengthen or shorten the pole by installing or removing segments, optionally of different length and/or construction in accordance with the desired use, or the pole shape can be changed. The pole segments can e.g. be made substantially from an aluminium alloy. Some or all the parts of the pole segments can also be made from a bending stable plastic, which is more particularly reinforced with fibers (e.g. carbon or glass fibers).

Adjacent pole segments can be rigidly interconnected, e.g. screwed together. Advantageously two successive pole segments are interconnected by means of a swivel joint, particularly a swivel. This can permit a relative rotation of the adjacent pole segments about the local pole axis. A swivel joint can be used for relieving the coupling means of torsional forces acting in the pole. It can in particular be located close to the coupling means, especially in the craft-side half of the pole and preferably in the last quarter thereof. In order to obtain a high torsional resistance of a pole segment at the same time as a relatively low weight, it can be advantageous if one pole segment has a torsionally stable multicomponent structure, particularly if it has terminal end plates, which are interconnected by means of at least three non-coplanar positioned rods. The coupling means can be of a random nature allowing a movable connection of the pole end region and the craft. The coupling means can be constituted by known couplings or linkages, e.g. trailer couplings, such as are conventionally used on trucks or lorries, as well as car ball-ended linkages. However, it is also possible to use swivel arrangements such as are employed on semitrailers. Advantageously the coupling means have a holder preferably connected in articulated manner to a pole or pole segment and in which is located a connecting member rotatably mounted about a substantially vertical rotation axis for connection to a land craft. The connection element is preferably constructed for connection to a top surface of the craft, e.g. its roof. The pole shape can be constructed in accordance with the connection point to the craft and the shape thereof, so that a free rotation of the craft under the pole is possible. An overhead swivel coupling of this type allows extreme cornering movements and also a change to the movement direction of the search system comprising the craft and probe carry vehicle in an extremely confined space without disassembly.

The probe carrier of an embodiment is essentially a supporting frame. The supporting frame rigidly connected to the pole can be made from a preferably light, bending-resistant material, e.g. metal and in particular a high strength aluminium alloy. Advantageously the supporting frame is essentially made from an electrically non-conductive, bending resistant material, preferably carbon or glass fibre-reinforced plastic. As a result the probe carrier is particularly light and an interaction between the supporting frame and electromagnetically operating probes can be largely avoided. Advantageously the supporting frame can be assembled from detachably interconnected frame elements, which can facilitate repair and conversion work. A probe carrier, particularly a supporting frame can also have means for the detachable and preferably rigid connection to further probe carriers. Thus, several probe carriers or supporting frames, which carry either identical probes or those operating according to different principles can be interconnected in modular manner, particularly by plugging together or screwing. For widening the search width it is e.g. possible to juxtapose several probe carriers in a transverse arrangement. Tandem arrangements are also possible, in which several supporting frames are successively located in the movement direction. The successive arrangement is particularly advantageous if a supporting frame carries probes of one type, e.g. eddy current probes, whilst a following supporting frame e.g. carries magnetic field probes. Combinations of a transverse arrangement and tandem arrangement are also possible.

A probe carrier can have several probes, which are preferably of the same type and can optionally be identical. For increasing the search width the probes are positioned preferably transversely to the movement direction and are in particular equidistantly juxtaposed. The probes are preferably rigidly connected to the probe carrier. It is also possible for one or more of the probes to be movably guided relative to the probe carrier. Preferably in the case of a probe movement relative to the probe carrier, the orientation of the e.g. vertical probe axis to a preferably horizontal probe carrier plane remains unchanged. Thus, one probe can perform a reciprocating movement transversely to the movement direction, so that the search area can be scanned over a certain width. It is also possible for one or more probes to be placed on a rotating arm or the like rotating in a horizontal plane ("lawnmower principle"). An eddy current probe operating over a large area can also be formed by integrating into the base frame at least one coil winding having roughly the size of the latter or a base frame can itself be constructed as a winding, which can be a transmitting and/or receiving winding.

Different probe types can either be arranged within one probe carrier or a supporting frame, or preferably can be combined in different, coupled together probe carriers. The depth range of magnetic field probes is typically up to approximately 6 m. The search signals obtainable with eddy current probes come essentially from an area close to the surface, which typically extends to a depth of approximately 75 cm, the optimum action occurring at about a depth of 30 cm. Typical mine laying depths are in this shallow range. A combination of magnetic field probes and eddy current probes makes it possible to combine the information content of both processes, which are advantageously supplemented. It is therefore advantageous if there is at least one magnetic field probe and at least one eddy current probe. Preferably automatically switchover means are provided for permitting an alternating operation of the two probe types. This avoids reciprocal interference of the processes. The probes can in part project beyond or above the probe carrier and namely both upwards, e.g. between chains of a bogie assembly or optionally also sideways.

A probe carrier may have spacing means in form of a bogie assembly. The bogie assembly can have skids or preferably a large number of runners, which can optionally be individually suspended and sprung. It is also possible for the bogie assembly to be in the form of a so-called loop-wheel bogie assembly. This concept derives its light weight and simplicity from a continuous, elastic belt, which can e.g. be of steel and made in one piece, but which is advantageously made from a plastics material having corresponding characteristics. The belt can be forced at the front by an idler wheel and guide rolls and at the back by a sprocket wheel in a forced guidance mode. It is also possible to use guides without an idler wheel. There are neither support rolls, nor casters and consequently no conventional suspension system, which in conventional crafts is generally transferred to the casters. In a loopwheel bogie assembly the continuous belt, due to its elastic properties, is responsible for the spring suspension. In this system, which is an intermediate between a wheel and a chain drive, the idler wheel can be fixed to a movable rocker and take part in the horizontal and vertical continuous belt movements. Any impacts which occur can be absorbed by shock absorbers.

In a preferred embodiment the bogie assembly has at least one revolving chain drive, which is guided by guidance means associated with the probe carrier, particularly the supporting frame. One construction has a single, wide chain drive of this type. In the subsequently described embodiment there are two laterally spaced chain drives. However, there can be more than two, optionally laterally spaced chain drives. Chain drives can also be arranged successively in the movement direction.

The use of known chain drives, such as are e.g. used in crawler crafts, is also possible. A preferred chain drive has several parallel moving belts made from elastically resilient material, which are interconnected by bending elastic transverse connectors arranged transversely to the movement direction. Such chain drives are extremely longitudinally and transversely elastic and permit a good adaptation to the ground surface, which aids an advantageous, uniform ground spacing for the probes. The moving belts and transverse connectors are preferably made from substantially electrically non-conductive material, particularly plastic. The moving belts can also be made from rubber. An advantageous, low weight of the chain drives is achieved and no interference with the probes occurs, whilst at the same time avoiding corrosion.

The guidance means can e.g. have idler and/or deflecting wheels and/or guide ledges for lateral guidance. It is also possible to have roll strings of spring suspended and/or unsuspended rolls. In a preferred embodiment the guidance means comprise guide wheels for the lateral guidance of the chain drive, a guide wheel comprising at least one single wheel, but preferably two coaxial single wheels and in which each single wheel engages with its circumferential region in substantially lateral clearance-free manner in a longitudinal recess formed on the chain drive. Engagement preferably takes place from the inside of the chain drive. Preferably at least the bottom-side guide wheels engage substantially centrally on the chain drive. Consequently the ends of the transverse connectors are free and their bending elasticity leads to a transverse elasticity of the chain drive, which allows a close engagement of the chain drive, particularly a trough or the like running roughly in the movement direction. Together with the longitudinal elasticity of the chain drive, which can be further assisted by applying the bottom-side guide wheels to movable and optionally also suspended bogie assembly rockers, there is an extremely high adaptability of the longitudinally and transversely flexible chain drive to ground unevennesses. This assists the reduction of pressure peaks on the ground and leads to an extremely low bearing pressure of the chain, which can be roughly 8 g/cm$^2$, so that it is possible to travel over many pressure mines without blowing them up. Use on snow, sandy or boggy grounds is also made possible due to the limited bearing pressure.

The body or frame on a probe carrier, despite its running means, should be constructed in such a way that in the case of its damage or destruction, e.g. by an explosion, it can serve as a slide or sledge running on the ground, so that it can still be pulled out of the danger area. For this purpose it is advantageous to construct the frame with a large transverse tube diameter and the side plates at the bottom in arcuate manner and to ensure for adequate rounding effects, so as to avoid hooking into the terrain.

An aforementioned steering mechanism can be built up from electrically nonconductive components, so that the steering mechanism does not interfere with the probes. As a result of the steering mechanism the relative positioning of supporting frame and pole could be modified, particularly by rotating about a substantially vertical axis. It is also possible to have a self-contained drive acting on the bogie assembly, particularly on the passive chain drive referred to hereinbefore. This can comprise a preferably troublefree operating electric motor supplied with power by the land vehicle and which e.g. has a damped electromagnetic signature. It is also possible for the selfcontained drive to be driven by means of a force transmitter guided by the pole, such as a cardan shaft, the motor then being located on the craft. A pneumatic or hydraulic drive can be made from plastic.

If in the bogie assembly use is made of one or more chain drives, they can be guided by deflecting or guide means, so that the revolving chain drives define a chain interior adaptable as regards shape and dimensions to the requirements. The probes can be so positioned that they are entirely located within the chain interior. As a result of said probe arrangement in the free space of the chain rotation and the resulting overhead chain rotation, there is a protection of the probes located in the chain interior against objects penetrating from above, e.g. the branches of trees and the like.

Although the aforementioned chain construction is advantageous with respect to cross-country operation and the limited bearing pressure, for numerous applications it is possible to use a bogie assembly with wheels. They are preferably in single-axle form, so that the complete craft is in single-axle form in the manner of a sulky. The wheels can have rubber tires drawn onto a rim, similar to the very wide low cross-section car tires, but which should be entirely metal-free. In place of the conventional steel wire inserts in the cover and bead, such tires should contain Kevlar strands or rovings. As said tires are subject to very limited loading due to the desired, low ground bearing pressure, they can be operated entirely without pneumatic pressure, which also renders valves superfluous. It is also possible to introduce more or less elastic support elements, e.g. foam rings, into the tire interior, optionally also only partly filling the same. The rim should also be entirely metal-free, e.g. of plastic and can e.g. fix the tire beads, which in the case of normal car tires occurs as a result of the internal air pressure.

This arrangement is extremely simple and advantageous. As a result of the wide, soft low cross-section tires the probe carrier can be operated in very low-impact manner and at a higher search speed. It is also possible to avoid fallow land vegetation, large rocks and cross-pits by a bulging of the probe reception body or a starting slope, also in the case of grounding, hooking or damage. The wheels run on both dirt and asphalt roads in rumble-free and probe-protecting manner. As a result of the positioning of the drive axle far to the rear, nose-overs in the case of probe uncoupling or in steep terrain are avoided, which is particularly important, because usually in the vertical direction of the long probes they are located in reception tubes and project upwards well above the craft body. These reception tubes can also be closed at the bottom by caps, so as to avoid dirtying and ensure that the tubes do not become full when travelling through water or underwater.

It is preferable to cover the wheels in the manner of mud guards, at least at the front and top. This avoids the vegetation becoming entangled between the wheels and probe reception bodies, said vegetation being instead turned away and bent round.

These and further features can be gathered from the claims, description and drawings and the individual features, both singly and in the form of subcombinations, can be implemented in an embodiment of the invention and in other fields and can represent advantageous constructions. Embodiments of the invention are described in greater detail hereinafter relative to the drawings, wherein show:

DESCRIPTION OF PREFERRED EMBODIMENTS

Figure 1:
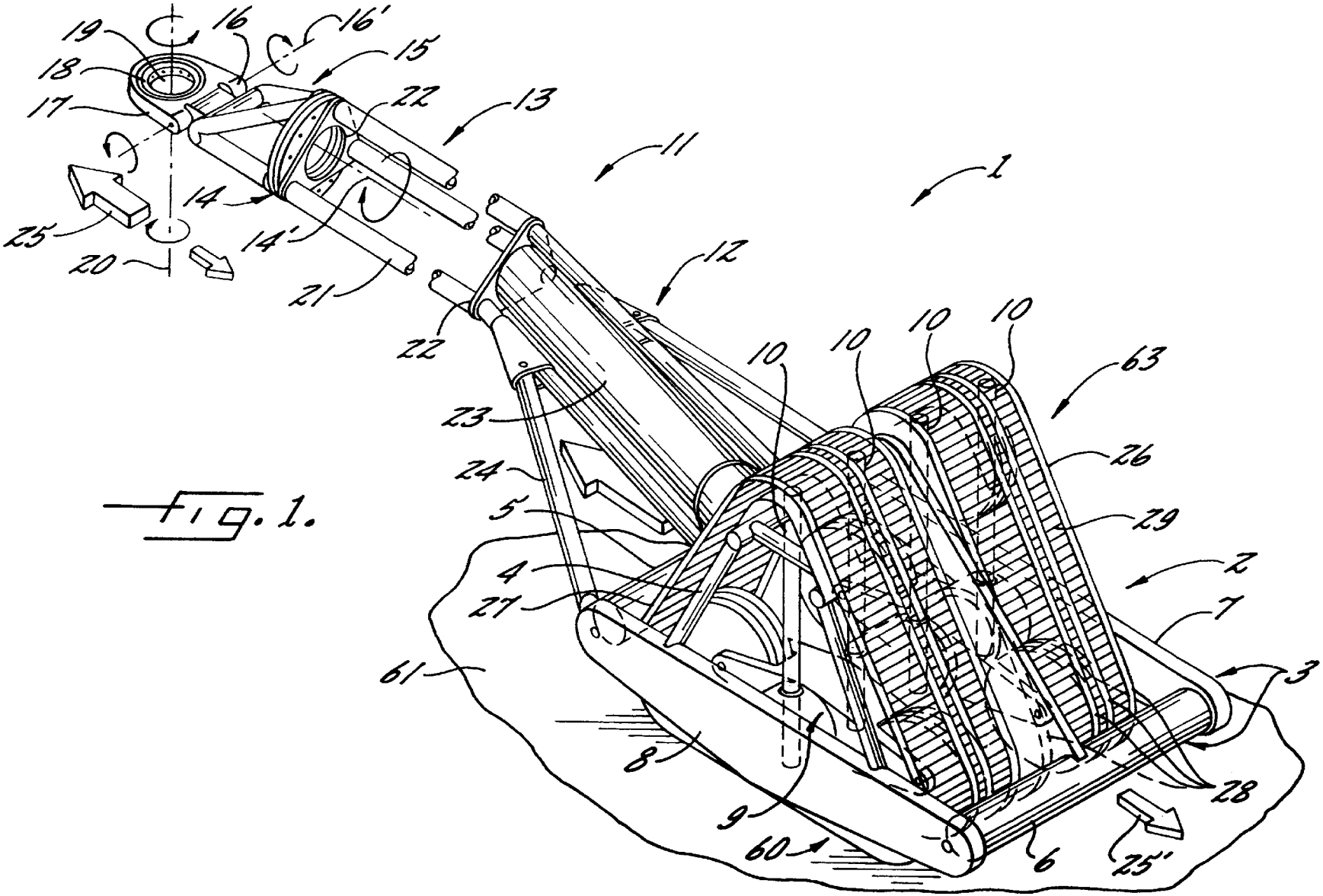
FIG. 1 A perspective, diagrammatic overall view of a portable probe carrying vehicle.

In the perspective, diagrammatic overall view of the portable probe carrying vehicle 1 in FIG. 1 certain non-transparent components are shown transparent in order to better illustrate the construction, so that details which would not be visible in this particular view are rendered visible. The probe carrying vehicle 1 has a pole 11 and a supporting frame 2 forming a probe carrier comprising several partly detachably interconnected components and which essentially comprise a base frame 3 rectangular in plan view and a support 4 connected thereto and roughly trapezoidal in side view. The base frame 3 and support 4 are essentially made from glass fibre-reinforced plastic. The base frame 3 is built up from a cross-sectionally round, front crossbar 5 and a cross-sectionally round, rear crossbar 6, which are interconnected by side plates 7, 8 screwed to the crossbars. A central crossbar 9 running centrally and parallel to the crossbars 5, 6 and screwed to the side plates 7, 8 and which can best be seen in FIG. 2, carries four magnetic field probes 10, which have the same lateral spacing on the central crossbar 9. The elongated, apparently tubular magnetic field probes 10 are vertically oriented to a substantially horizontal plane defined by the base frame 3 and namely as a result of the rigid connection between the base frame 3 and the magnetic field probes independently of the orientation in space of the base frame. As a result of a large diameter of the round crossbars and a rounded or bevelled underside of the side plates, the frame has a sledge form, which also when there is no chain drive in the case of an emergency can be pulled over the terrain and consequently forms a spacing means for maintaining the spacing between the probes and the ground.

The overall upwardly curved pole 11 is rigidly, but separably connected by a screw connection to the front crossbar 5. The pole is built up from several pole segments, which comprise the straight first pole segment 12 which slopes upwards with respect to the base frame 3 and is rigidly connected to the front crossbar, the straight second drawbar segment 13 which is also rigidly connected thereto by screwing, which runs roughly horizontally and forms with the first pole segment 12 an obtuse angle, and the short, bevelled, third pole segment 15 connected by means of a swivel 14 to the second pole segment. A frontal end plate 22 is mounted at each end of the second drawbar segment 13 to facilitate its rigid interconnection. The swivel 14 allows a free, relative rotation of the pole segments 13 adjacent thereto about the local pole axis 14'. To the third pole segment is connected in articulated manner by means of a joint 16 with a horizontal axis 16' a flat, substantially horizontally oriented holder 17. In a circular recess of the holder 17 is provided a swivel 18, which allows a rotation of a circular, horizontal connecting element 19 relative to the holder 17 about a substantially vertical axis 20. The connecting element 19 can be screwed to a correspondingly constructed counterelement, which can e.g. be fixed to the roof of a land craft, such as in particular a crosscountry and optionally also armoured military vehicle.

The probe carrier dimensions can be correspondingly large. In the embodiment shown the spacing between the connecting element 19 and the probes 10 is about 7 meters. The drawbar segments are correspondingly large and are in particular torsionally strong. Thus, e.g. the second pole segment 13 has three cross-sectionally round rods 21, which are parallel to one another and in cross-section form an isosceles triangle. The three rods are in each case frontally connected to substantially triangular end plates. This construction is torsionally stable and at the same time relatively light. The inner space formed between the three rods is protected. In it can e.g. run cable ducts or the like through which can pass supply and signal lines for the magnetic field probe 10. For the protection of these lines and for additionally stiffening a pole segment, it is also possible to provide a central tube 23, as can be seen in the first pole segment 12. On the first pole segment 12 are also laterally provided guide rods 24 sloping up from the front corners of the base frame 3. They are used on the one hand for the additional stiffening of the arrangement. However, on the other hand said means are also advantageous because when the probe carrier is moving in the movement direction 25, i.e. when it is being pulled, they prevent trapping obstacles, e.g. stones, trees or the like on the front crossbar 5 of the base frame 3 and consequently would impede further travel or could damage the probe carrier. Instead obstacles are laterally pushed aside and/or the probe carrier is laterally pushed aside. Removal means can also be provided on the support element for thrust operation in movement direction 25'.

Figure 2:
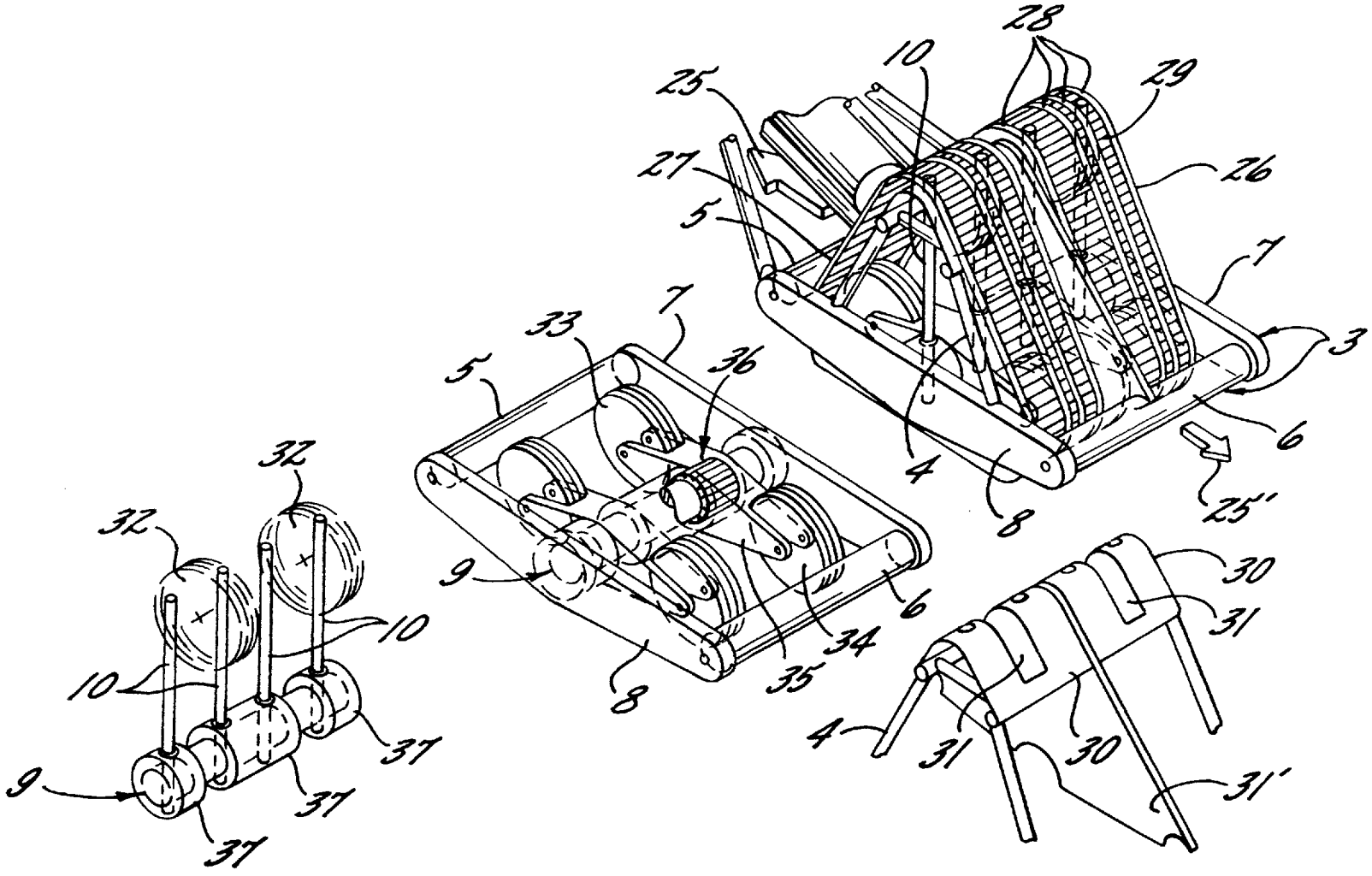
FIG. 2 A perspective, diagrammatic partial view of a portable probe carrying vehicle with a more detailed representation of individual component arrangements.

With the supporting frame 2 are associated means 60 for maintaining the spacing between the probes and the ground area 61 to be searched, which mainly comprise a bogie assembly 63 to be described in conjunction with FIG. 2. in the represented embodiment it comprises two wide chain drives 26, 27, which in each case revolve on an in side view roughly triangular path. The magnetic field probes 10 are completely located within the free space of the chain revolution, so that the chain drives protect the magnetic field probes, particularly in the upwards direction. Such an overhead chain rotation is advantageous and can also be implemented by other than triangular rotary configurations. It can e.g. also be implemented with a chain upper side running horizontally between deflecting means and/or with a starting bevel or vertically rising chain sections. Another, not shown embodiment only has a single wide chain drive.

Figure 3:
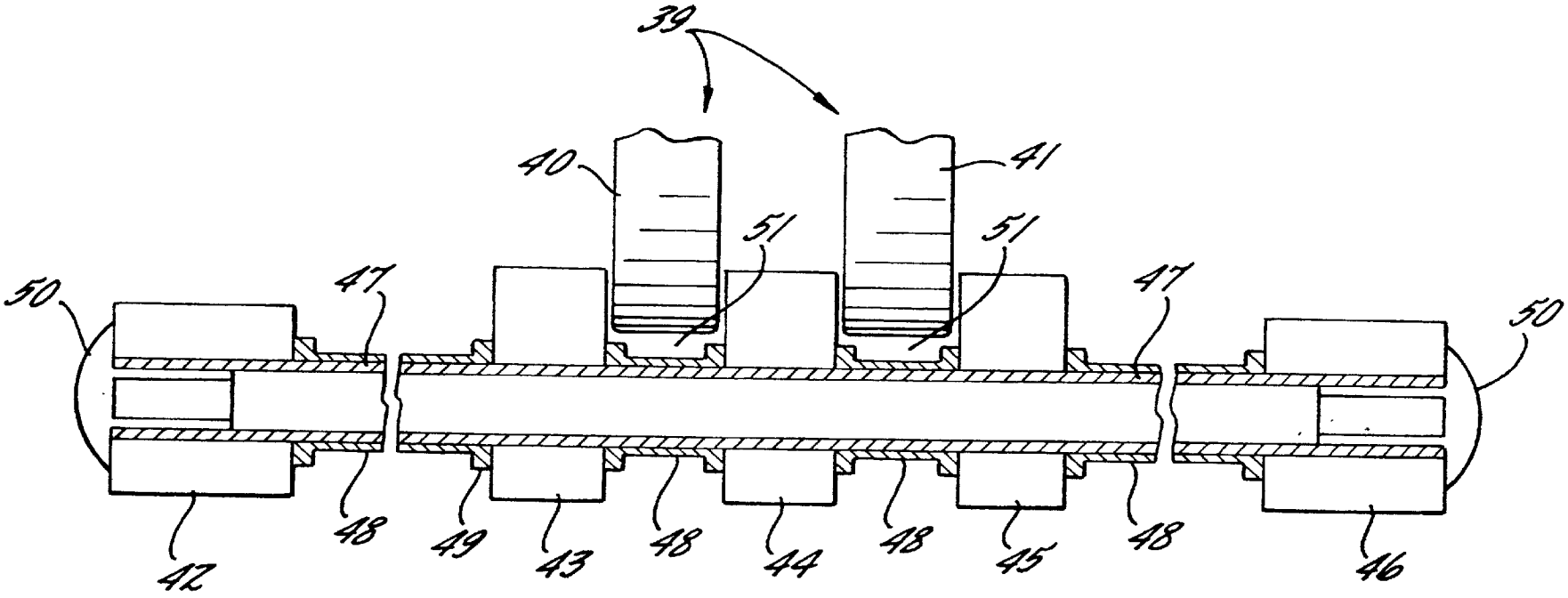
FIG. 3 A part diagrammatic cross-sectional view through a chain drive guided by a guide wheel and having a transverse connector.

The chain drives to be described in greater detail in conjunction with FIG. 3 are advantageously continuous, i.e. without a chain lock. They can be replaced in that one of the removable side plates 7, 8 of the base frame 3 is removed and the corresponding chain removed. A chain drive has several parallel moving belts 28 made from elastically resilient material, which are interconnected by bending-elastic transverse connectors 29 positioned transversely to movement direction 25. The moving belts and transverse connectors in the represented embodiment are essentially made from plastic, which is not electrically conductive and also causes no interfering interaction with the probes.

The chain drives are guided by guidance means associated with the supporting frame. Said guidance means comprise in the upper area of the chain rotation deflecting elements 30 positioned above the magnetic field probe 10 and which are fixed in the upper area of the support 4 and in side view have the form of an inverted V with rounded top. In the deflecting elements 30 are in each case provided central, slot-like pieces 31, which run parallel to the movement direction 25 and through which from the insides engage upper guide wheels 32 on the chain drives. Between the deflecting elements 30 is fixed to the support 4 a partition 31' oriented vertically downwards to the plane of the base frame 3, which is substantially triangular and parallel to the movement direction 25.

The upper guide wheels 32 are rotatable about an axis parallel to the crossbars 5, 6 and mounted on the upper part of the support 4. The upper guide wheels 32 are used for the lateral guidance of the chain drive. Each guide wheel has two coaxial single wheels and each single wheel engages with its circumferential area in substantially clearance-free manner in a longitudinal recess formed on the chain drive between parallel moving belts (cf. FIG. 3).

Identical plastic guide wheels are also located in the bottom-side area of the chain drive. For each of the two juxtaposed chain drives 26, 27 there are two bottom-side guide wheels 33, 34, which are successively rotatably mounted on a common bogie assembly rocker 35 in the movement direction 25. The rocker 35 has a symmetrical construction with respect to the central crossbar 5 and by means of a roller bearing 36 is pivotably mounted on the central crossbar 9 about a substantially horizontal pivot pin running perpendicular to the movement direction. As a result of this mounting an upward movement of the front, bottom-side guide wheel 33 brings about a corresponding downward movement of the rear, bottom-side guide wheel 34 and vice versa. Considered in the movement direction between the bottom-side guide wheels, the chain drive in each case laterally guided by the same runs freely, which ensures a high degree of longitudinal elasticity of the chain, which is further assisted by the mounting of the guide wheels on the bogie assembly rocker 35. In other embodiments there can also be single wheel suspensions, which can optionally be spring-suspended. It is also possible to have more than two guide wheels per chain drive.

As shown in FIG. 3, the bottom-side guide wheels engage substantially centrally on the chain drive. Therefore the lateral ends of the transverse connectors remain free, which aids a particularly high transverse elasticity of the chain drive in the bottom area. Overall the chain drive can adapt and engage very well with ground unevennesses in both the longitudinal and transverse directions, without the travelling over of said unevennesses leading to significant tilting or pitching movements of the base frame 3 from its preferably horizontal orientation. Therefore, also the magnetic field probes 10 remain substantially vertically oriented to the ground travelled over, because they are rigidly connected to the base frame 3. This rigid connection is achieved in that the magnetic field probes are fixed to vertical holes in holding sleeves 37, which are in turn secured to the base frame 3 on the central crossbar 9. In the gaps between the holding sleeves 37 are arranged in substantially clearance-free manner the bogie assembly rockers 35, so that the holding sleeves 37 simultaneously laterally guide said rockers 35.

FIG. 3 shows the construction in the preferred embodiment of a chain drive 38, which is laterally guided by a guide wheel 39 having two coaxial single wheels 40, 41. The chain drive 38 comprises several parallel moving belts 42 to 46, which have a through, rectangular cross-section. The moving belts can also be chain-like or e.g. toothed belt-like. In the represented embodiment they are made from elastically resilient plastic. The moving belts are interconnected by tubular transverse elements 47 (only one of which is shown in FIG. 3) running transversely to the movement direction. To secure the moving belts against an axial displacement on the transverse elements 47 between said belts are located spacing sleeves 48 with flange-like edges 49 on the tubular transverse elements 47. Into the open front sides of the tubular transverse element 47 are screwed screws 50 with flange-like, laterally projecting, wide heads by means of which the overall arrangement can be fixed together. It is also possible to use as a fixing element an inner bar to be passed through the tubular transverse element and which can be somewhat shorter than the transverse element 47 and into which can be screwed the corresponding end disks. The three identical, central moving belts 43 to 45 are arranged symmetrically to the center of the chain drive with the same axial spacing. Between them on the side facing the guide wheel 39 there are slot-like longitudinal recesses 51 with vertical side walls. The outer circumference of each single wheel 40, 41 engages in one of the longitudinal recesses 51. Each longitudinal recess 51 forms two vertical, lateral guide surfaces for the single wheel engaging therein, so that in all there are four lateral guide surfaces between the guide wheel and the chain drive, which allows a particularly reliable lateral guidance. In this advantageous guidance mode the ends of the transverse connectors remain free so as to ensure a high transverse elasticity of the chain drive.

The probe carrying vehicle 1 shown in FIGS. 4 to 7 comprises a pole 11 and a probe carrier 62 in the form of a horizontal end-closed cylinder or probe carrier body 64 elongated transversely to the pole extension. From the end faces 65 project axle journals 66 and namely from the lower cylinder portion rearwardly displaced with respect to the pole, so that a single-axle, two-wheel truck is formed, whose wheels can also lag with respect to the cylindrical probe support body 64.

The pole 11 is made from an upwardly bent, reinforced plastic tube with lateral guide rods 24 in accordance with FIG. 1. It can be removed from the probe support body 64, so that the latter and the pole can be mounted or transported parallel to one another. On its front end the pole has a coupling 67 for coupling to a craft 68, e.g. a conventional trailer ballended linkage or, optionally replaceable with respect to the latter, a coupling bolt for a standard ballast truck jaw coupling.

On the axle journals 66 are mounted wheels 69, which in each case comprise a rim 70 and a tire 71. The tire is made from a rubber-like material similar to a pneumatic vehicle tire in the low cross-section format, i.e. with a very considerable width compared with the height of the tire cross-section. The tire tread 72 can, but should not be profiled in order to avoid a "gathering" of metallic parts, which could interfere with the measurement.

The tire is made from an artificial or natural rubber and provided with nonmetallic reinforcements, e.g. Kevlar strands or rovings. Together with several such strands running circumferentially in the tread, they also pass in cruciform manner over the sides 73 of the tire 71. The bead 74 is also metal-free and contains in place of the standard metal wire rings corresponding metal-free reinforcements.

The tire 71 is fixed at its beads 74 between two ring disks 75, 76 of the rim. These, including the screws connecting them, are made from a metal-free material, e.g. plastic. With the corresponding shape-outs 77 they constitute the bead and consequently secure the tire to the rim. During fitting firstly the inner rim rings 76 from the cylinder ring 78 are introduced into the tire interior and subsequently the outer disks 75 are screwed down firmly with screws 80.

Figure 7:
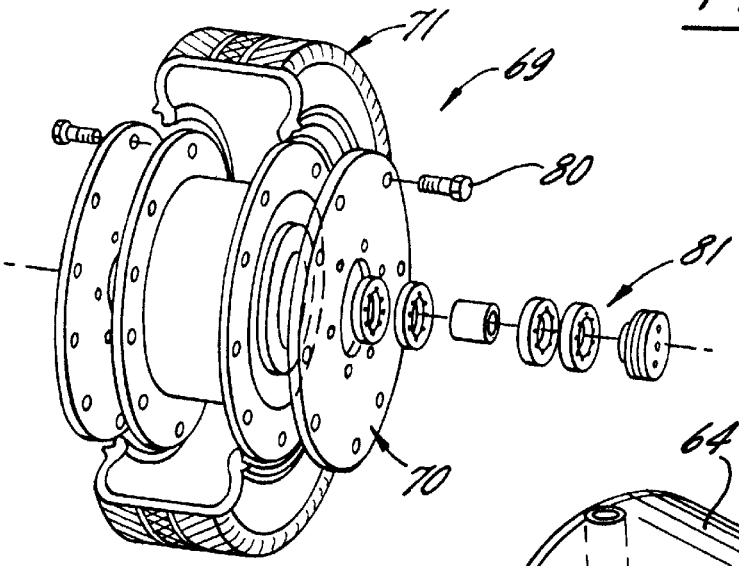
FIG. 7 A part sectional exploded view of tire and rim.

FIG. 7 shows plastic ball bearings 81 and their fastening parts with which the rim is mounted in rotary manner on the axle 66.

The use of low cross-section rubber tires with a metal-free construction is particularly advantageous in connection with probe carriers, because consequently a wheel is made available, which with a very large bearing width and therefore relatively low bearing pressure operates reliable even under the roughest conditions. The fact that there is no need to build up a pneumatic pressure in the tire interior 71 simplifies the construction even further and ensures for gentle running of the probe carrier which is very light compared with the tire size. The tire and in particular its sides 73 have an adequate inherent stability, as well as flexibility, in order to absorb the corresponding forces and impacts without any supporting inner pressure.

Figure 8:
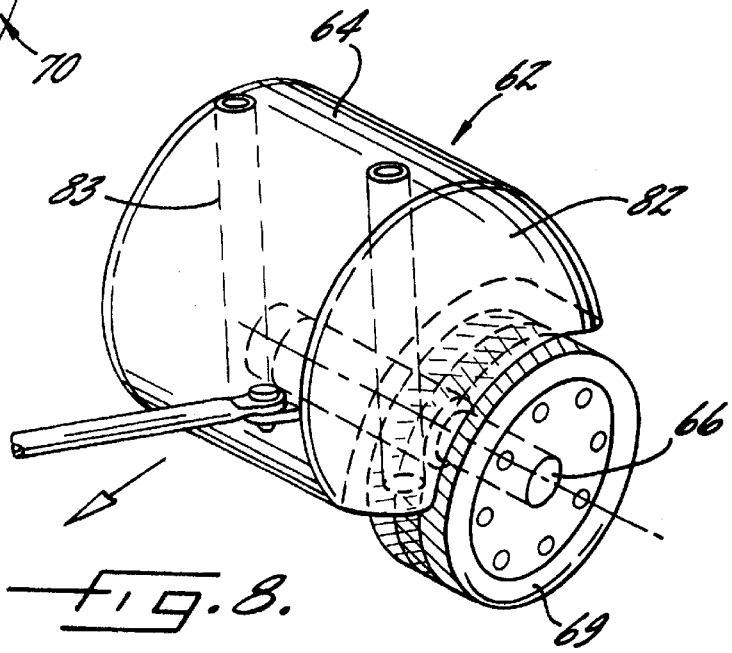
FIG. 8 A detail of a probe carrier with wheel covers shown partly transparently for illustration purposes.

FIG. 8 shows the probe support body 64 of the probe carrier 11, with in each case one of the wheels 69 at the front and top-covering cover 82 in the manner of mud guards. The covers 82, as shown in FIG. 8, can be fitted as separate parts but, as shown in FIG. 9, can also be constructed as an integral component of the body 64.

The probe carrier 62 carries magnetic field probes 10, which are constructed as long rods and are inserted in plug-in sleeves or reception tubes 83, which substantially vertically traverse the probe carrier body 64. The magnetic field probes 10 project far beyond the probe carrier body 64 and can be vertically adjusted by means of a clamping bolt 84. The probes and their reception tubes are readily accessible from the back of the probe carrier. The probes 10 are centered and slide-protected within the plug-in sleeves in the form of an adjusting taper of the probe carrier reception tube 83, which can be closed at the bottom and optionally sealed at the top. Several, e.g. five tubes are juxtaposed in a row. In the construction according to FIG. 8 there is in each case one further probe in the vicinity of the covers 82 in order to extend the search width to essentially the total width of the probe carrier.

Figure 9:
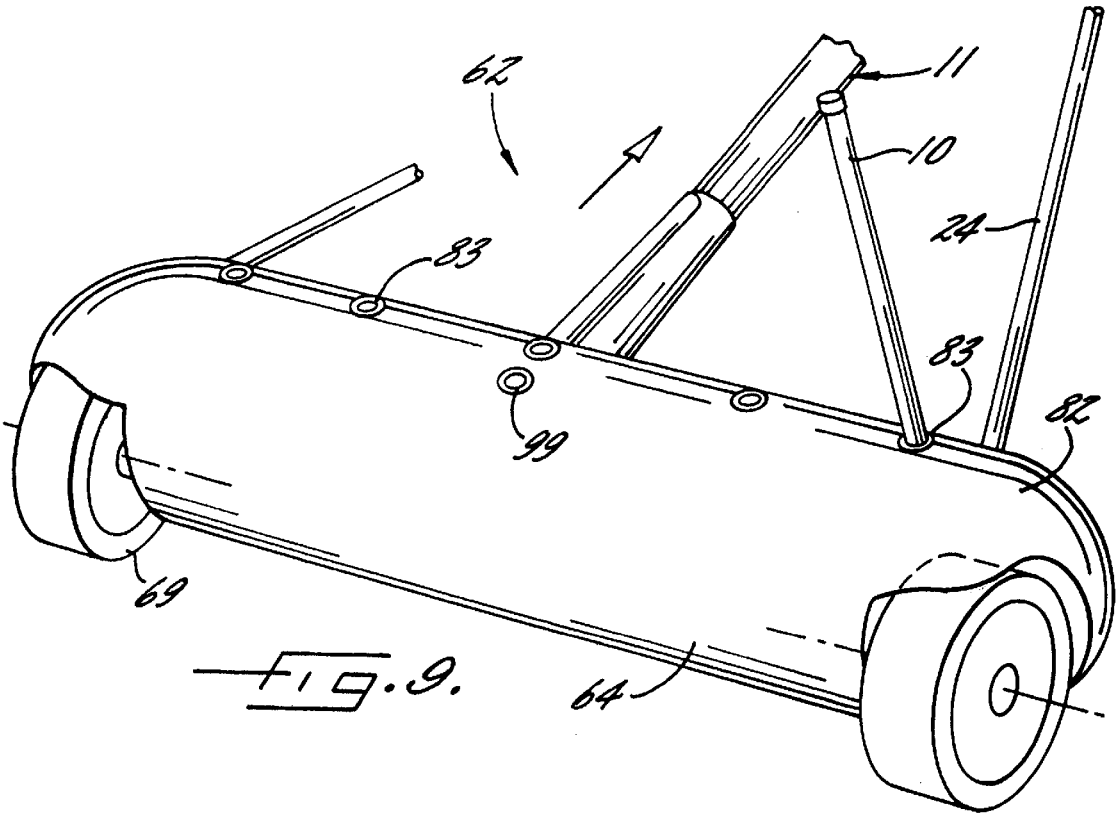
FIG. 9 A perspective view of a probe carrier having the construction of FIG. 8.

In FIG. 9, in addition to the probe receptacle tubes 83 there is a similar, central receptacle 99 for a GPS antenna or a laser location mirror-carrying mast.

Figure 10:
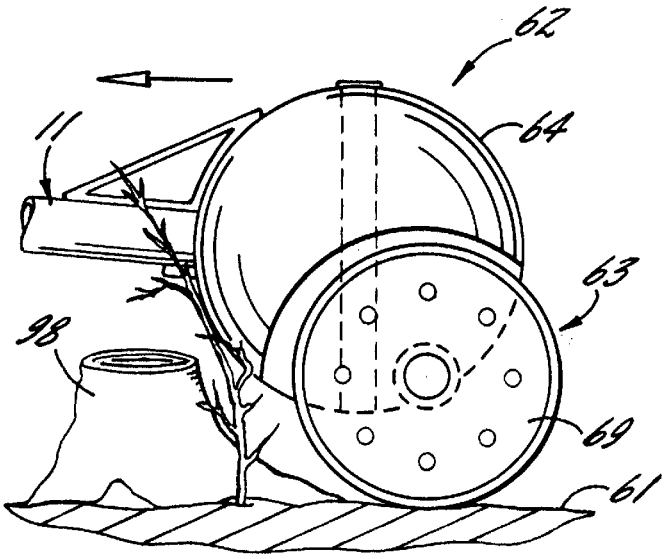
FIGS. 10+11 Details of the probe carrier according to FIGS. 8 and 9 when used in the terrain.

It can be seen that this probe carrier can be manufactured relatively easily, completely without metal, but still in a very robust manner. The pole and probe carrier body 64, including the axle journals and reception tubes 83 can also be made from high-strength, metal-free materials, such as glass fibre, Kevlar or carbon fibre-reinforced plastic. As a result of the wheel construction trailing behind the roller-like probe carrier body it is also possible to clear obstacles, such as rocks, tree trunks 98 or the like (cf. FIG. 10). The roller-like underside of the probe carrier body 64 serves as a sledge or guide plate on which the probe carrier can be raised over said obstacles, even if said obstacles outside the wheel track are higher than the ground freedom of the probe carrier.

Figure 11:
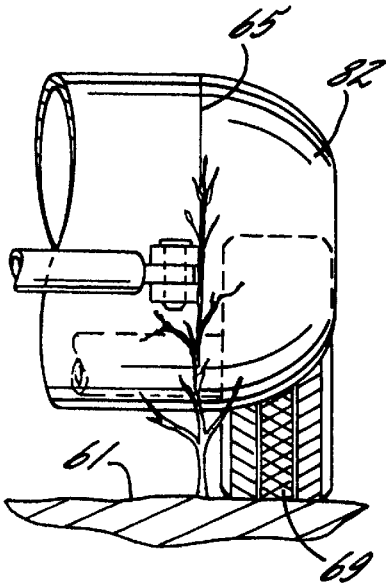

FIG. 11 shows that any vegetation moved aside by the guide rods 24 is prevented by the cover 82 from entering the gap between the end faces 65 of the probe carrier body 64 and the wheels, although the axle 66 is stationary, so as to wind around the same under the action of the wheel rotation.

Figures 4, 5:
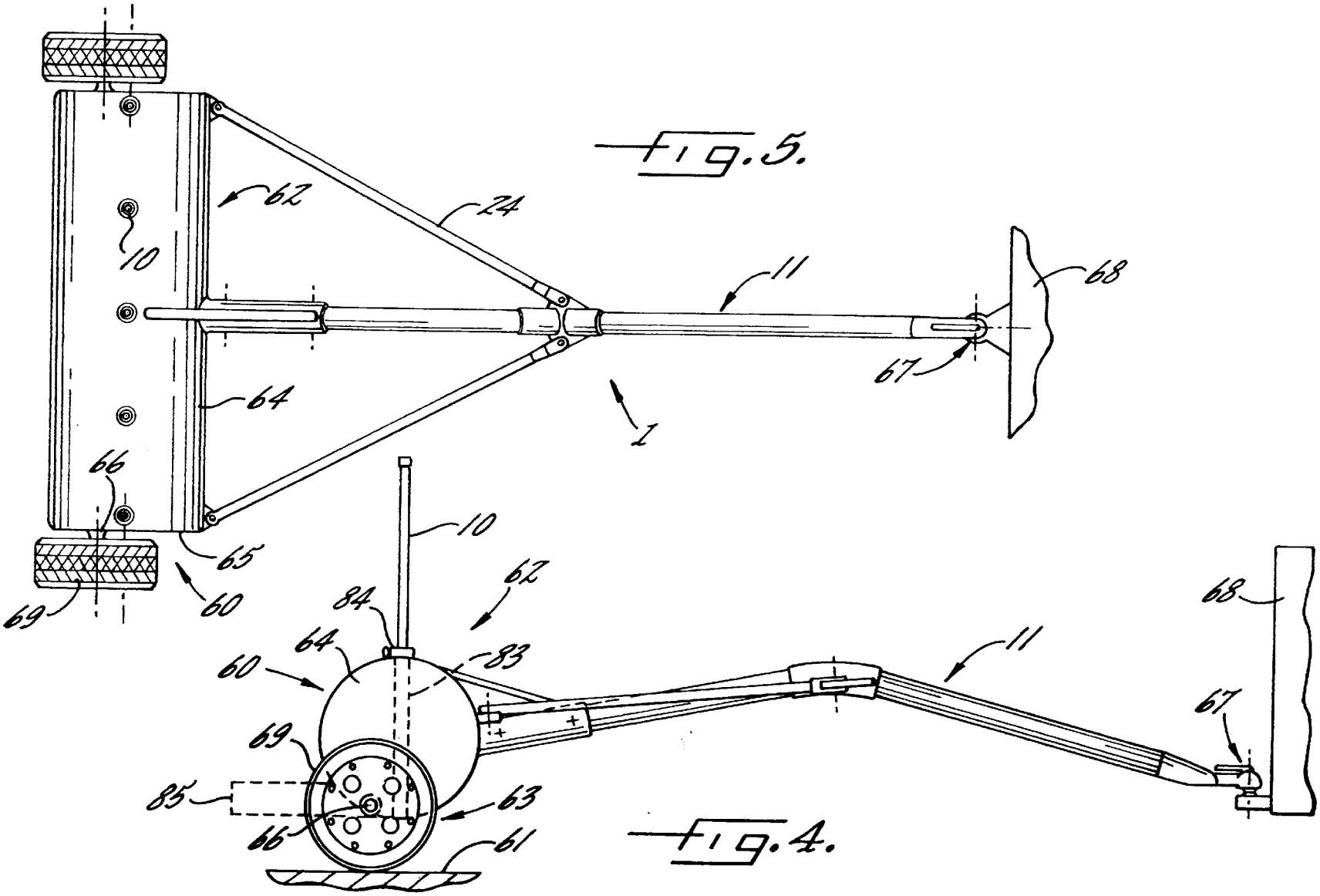
FIGS. 4+5 A probe carrying vehicle in side and plan view.
Figure 6:
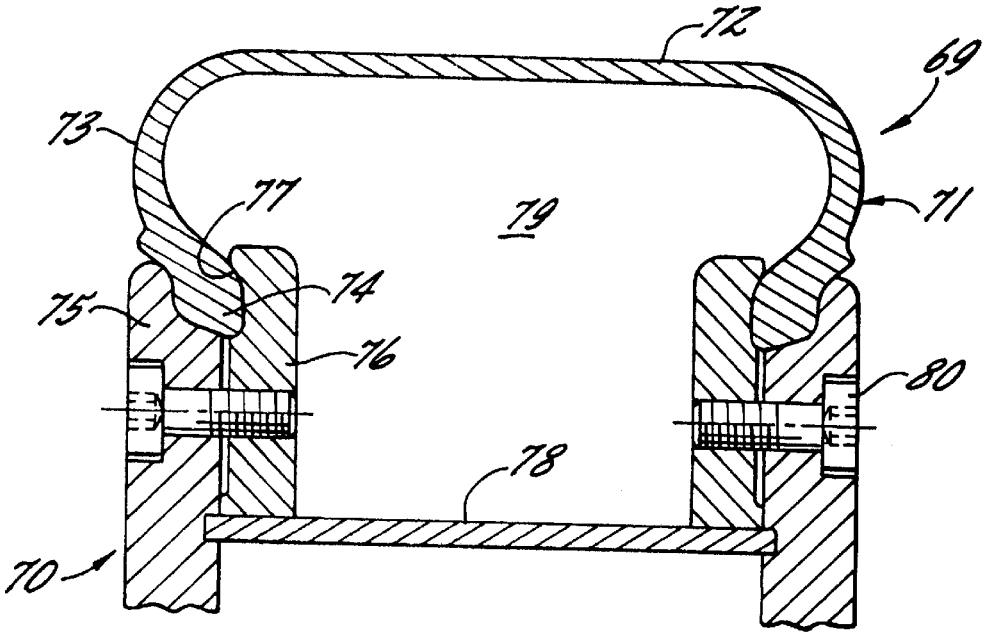
FIG. 6 A cross-section through a tire and part of its rim.

FIG. 4 shows that, apart from the magnetic field probes 10, which react as passive probes to changes or deflections of the earth's magnetic field and consequently make it possible to detect ferromagnetic parts at great depths below the ground 61, it is also possible to use other probe types, which can be located in the broken line-indicated cantilever arm 85 at the rear of the probe carrier. These can be inductive probes operating on the basis of the eddy current principle, which can also locate non-ferromagnetic metal parts. An arrangement corresponding to the cantilever arm 85 is also suitable as a platform for the carrying along of an operator, e.g. for optical monitoring purposes or for collecting fragments.

Figure 12:
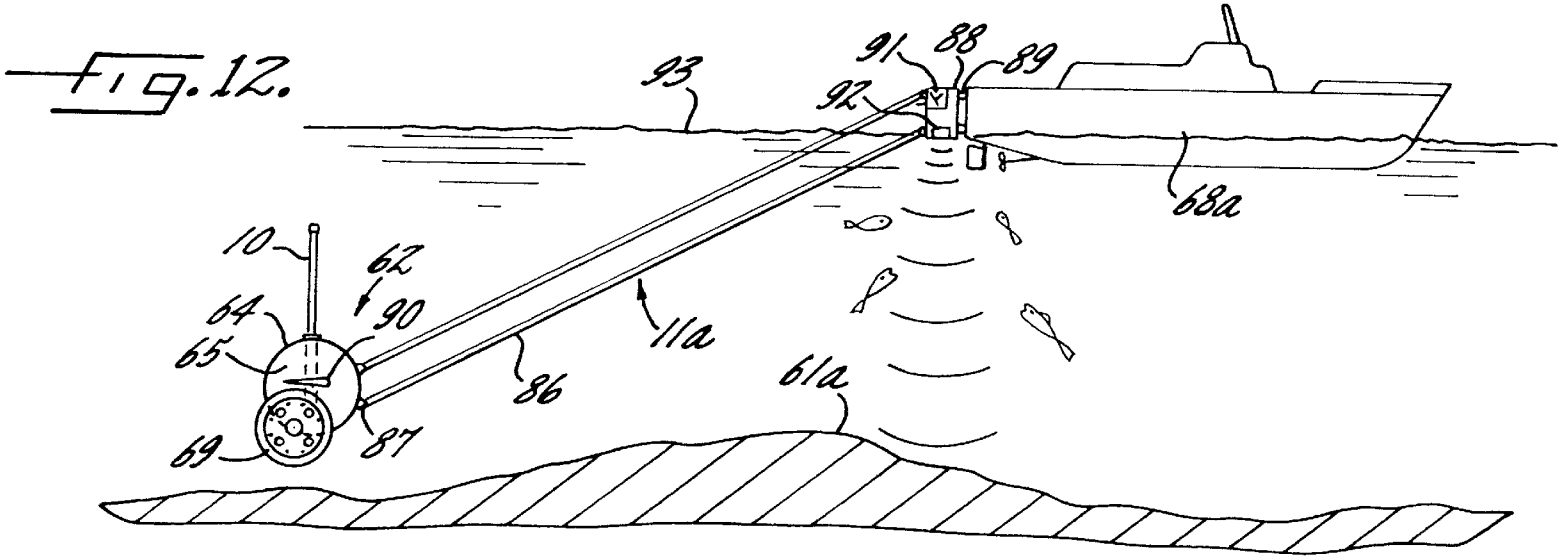
FIGS. 12–14 A probe carrier modified or constructed for underwater use in three working positions.
Figure 13:
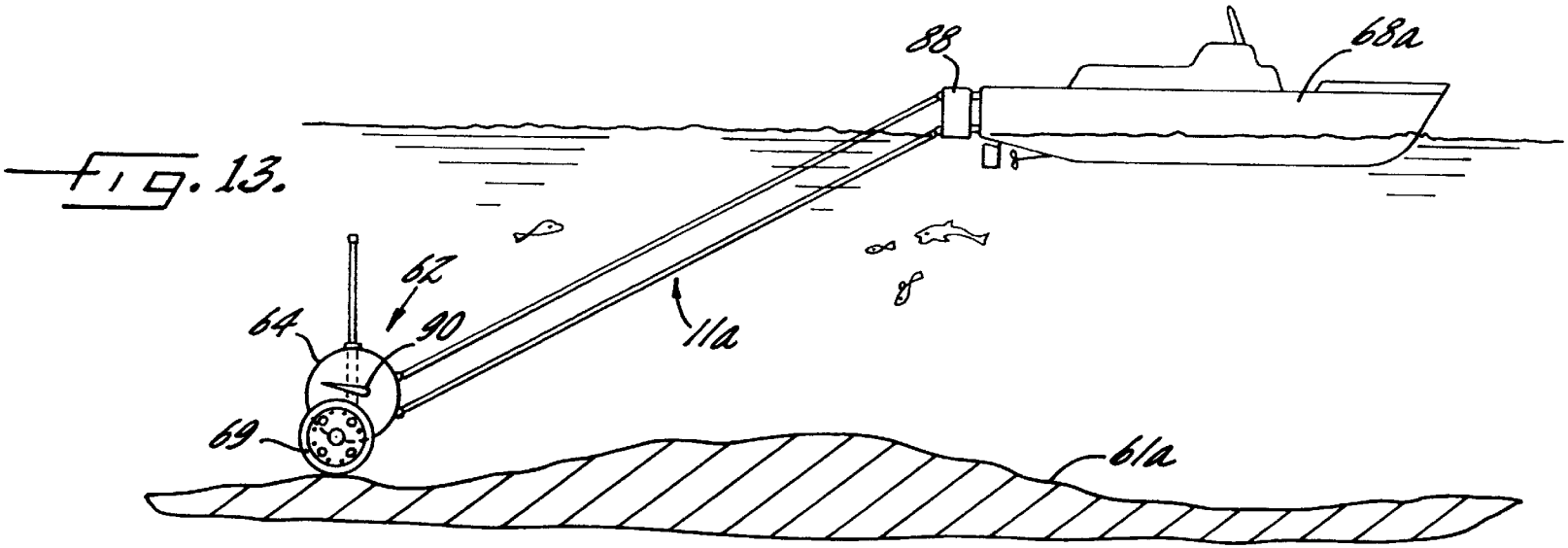
Figure 14:
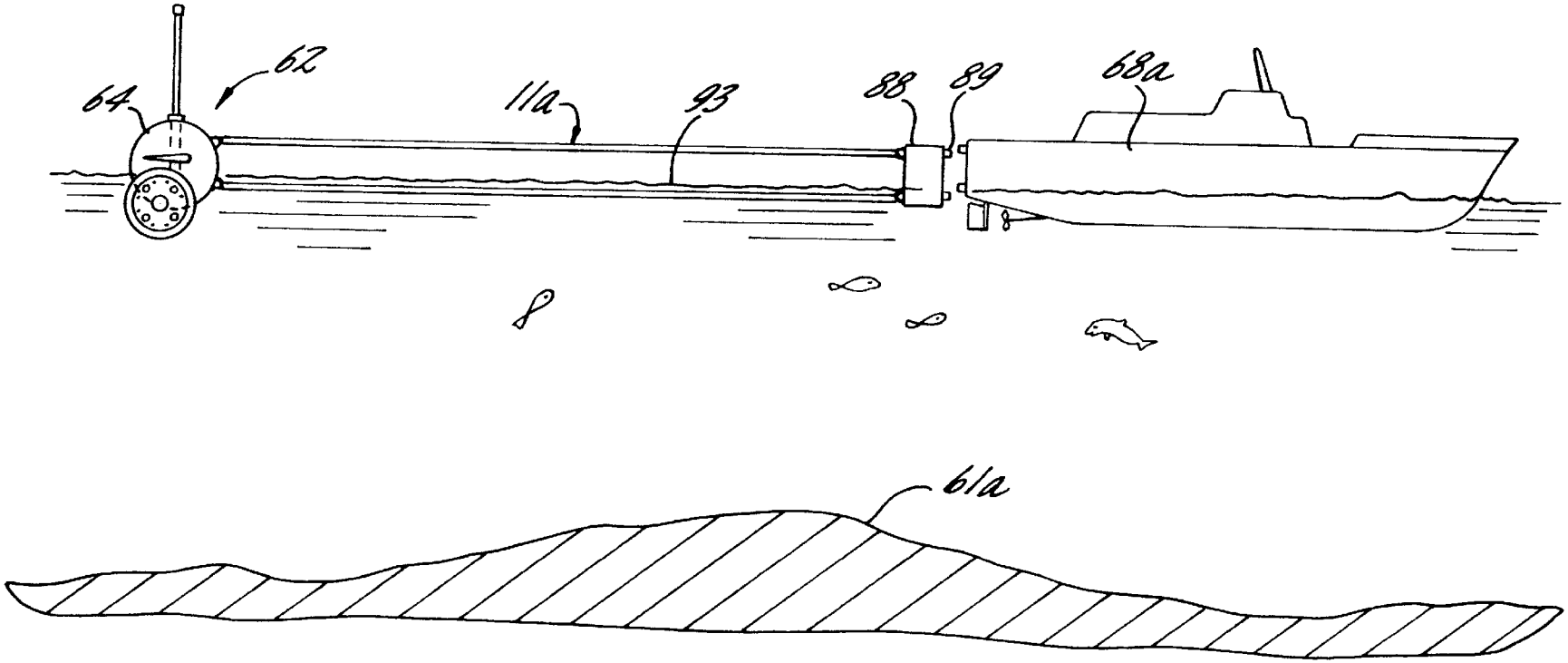

FIGS. 12 to 14 show a probe carrying vehicle 1 modified for underwater use. Its probe carrier 62 with probe carrier body 64 and wheel 69 largely correspond to FIGS. 4 and 5. In place of the pole rigidly fitted to the probe carrier body 64 is now provided a pole 11*a*, which is formed from two long, parallel struts or tubes 86, which is in each case pivotable about a horizontal pivot pin 87 on the probe carrier body 64 and, on the opposite side, are articulated to a floatable base element 88 in the form of a floating body or box. They form a pivotable parallelogram making it possible to guide the probe carrier body 64 with the probes in each depth position attainable by the pole 11*a* in the same orientation, i.e. with the probes 10 in the vertical orientation, provided that the base element 88 remains in the corresponding orientation.

The base element 88 is provided with coupling devices 89 with which it can be coupled to the rear of a watercraft 68*a*. This coupling can optionally take place elastically, so that in the case of sea swell of the watercraft excessive forces do not act on the pole 11*a*. In this construction the probe carrier body is constructed as a flood chamber which, controlled by the watercraft 68*a*, is flooded and by means of its own compressed air reservoir or by means of an air guidance system in the tubes 86 can be refilled with air, so that the probe carrier 62 can submerge and reemerge in much the same way as a submarine, without corresponding raising and lowering forces having to be exerted by means of the pole.

During flooding preferably a state of equilibrium is set, in that the probe receptacle floats in water or is given a somewhat greater ballasting in order to compensate the forces produced by the water resistance during movement.

For precise depth control purposes there is a diving rudder in the form of a horizontal wing or rudder 90 projecting laterally over and beyond the end faces 65 and which by means of suitable control means (cable lines, hydraulics, etc.) is controllable from the craft 68*a* or the base element 88. The base element contains most of the supply, control and measuring means, e.g. also evaluating devices for the probes 10. In it is also provided a depth measuring device 91 for the probe carrier 62, which can operate e.g. by means of an angular measurement of the tube 86 with respect to the horizontal and an echo depth finder 92 for determining the depth of the ocean bed 61*a* below the water surface 93. By influencing the flooding and the diving rudder 90, the probe carrier can be guided to a predetermined distance above the ocean bed 61*a*, the echo depth finder 92 determining the corresponding ocean bed profile and as a function thereof and with a displacement corresponding to the pole length 11*a* makes the probe carrier follow this profile. For this specific underwater use, the probe carrier can be clad or given a particularly flow-favourable construction. For this floating use function, the wheels 69 are not necessary, but help when overcoming underwater obstacles, which can no longer be dynamically eliminated.

FIG. 13 shows the possible use as a probe carrier rolling on the ocean bed 61*a* by means of the wheels 69. This is particularly appropriate in the case of a hard, sandy bed, because it permits a smaller distance from the bed and therefore a particularly precise location. In this case the probe carrier 62 is more strongly flooded or provided with ballast. Optionally, also by a corresponding negative setting of the depth tube 90, which establishes the depth of the carrier 62 under the water, it would be possible to bring about a dynamic compensation of the upwardly directed component of the towing forces.

For stopping or salvaging the search equipment according to FIG. 14 the probe carrier 62 can be raised to the surface by blowing out the flood tank. The base element 88 can then be uncoupled from the vehicle and, e.g. using dinghies or directly from the ship, the equipment can be brought alongside, broken down into suitable portions and stowed on the deck. It can be seen that the probe carrying vehicle is shown on a greatly increased scale compared with the vehicle to facilitate understanding. It is also possible to use other parallel guide types or e.g. to directly articulate the tubes 86 to the watercraft.

Figure 15:
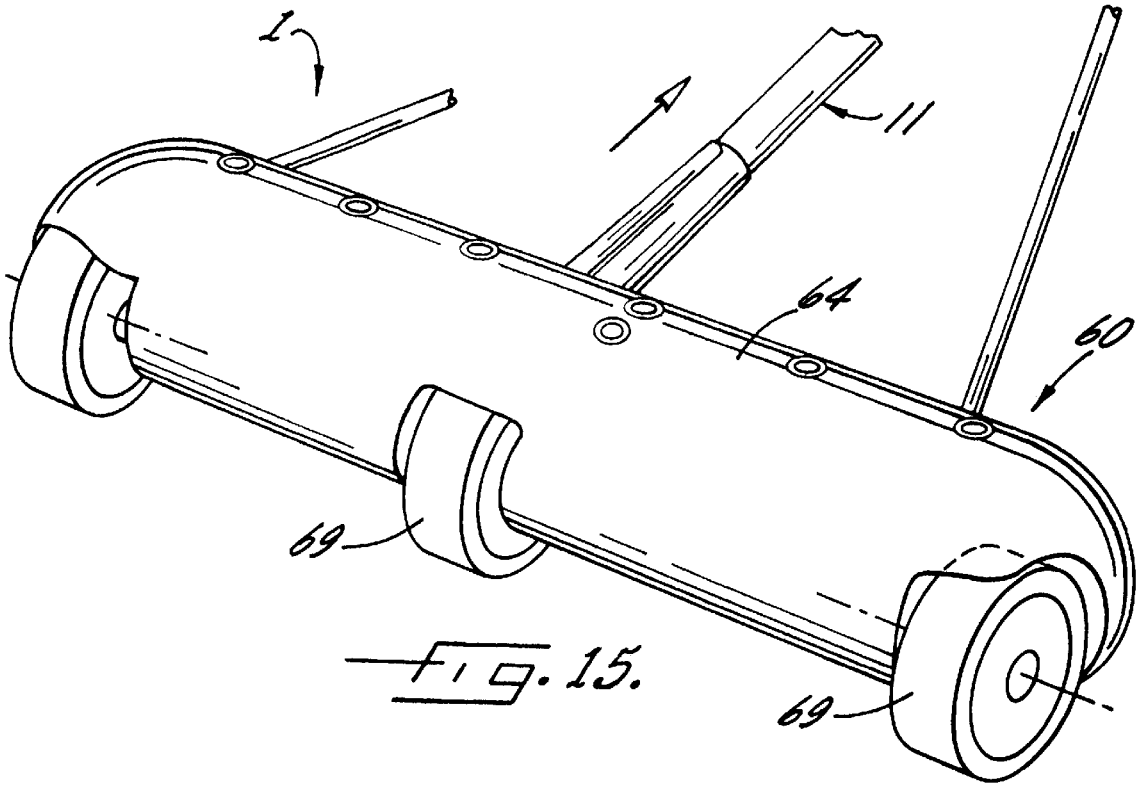
FIG. 15 A probe carrier with a multiple wheel arrangement.

FIG. 15 shows a construction in which, in addition to the lateral wheels, there is also a wheel 69 in the centre of the probe carrier body 64. Through the arrangement of one or more additional wheels between the lateral wheel 69, it is possible to produce very wide probe carriers with limited ground freedom and therefore a limited probe distance from the ground, which can operate in uneven terrain without excessively frequent chassis collisions.

Figure 16:
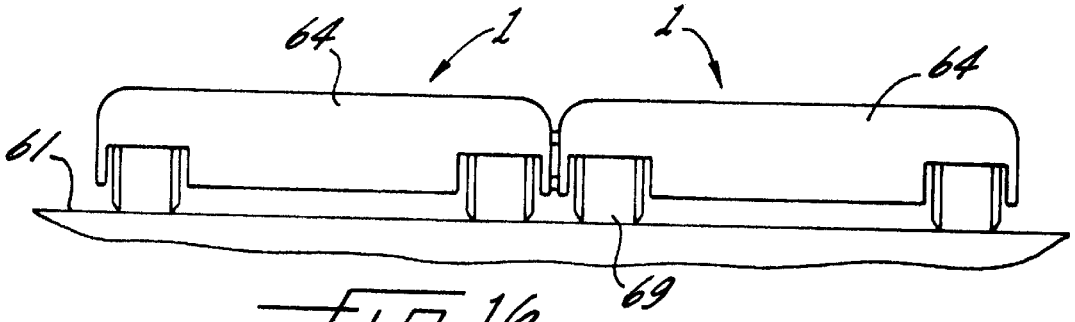
FIG. 16 The diagrammatic representation of a side coupling of two probe carriers.

FIG. 16 shows the lateral coupling of two probe carrying vehicles 1 towed together or by means of two interconnected poles. They can be interconnected in fixed or articulated manner, so that they can adapt to the terrain in the transverse orientation thereof.

Figure 17:
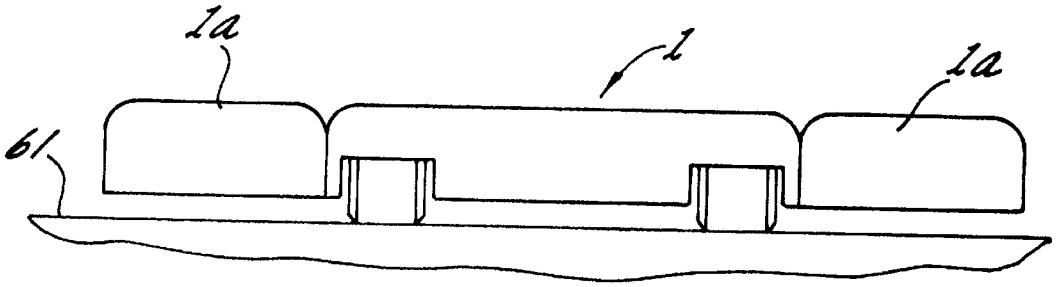
FIG. 17 The diagrammatic representation of a probe carrier according to FIG. 9 with lateral cantilever arms.

The probe carrier cantilever arms 1*a* laterally connected to the probe carrier in FIG. 17 are firmly connected to the central probe carrying vehicle rolling on the ground with wheels 69. These can be additionally used e.g. in the case of very flat terrain in order to increase the search width.

Figure 18:
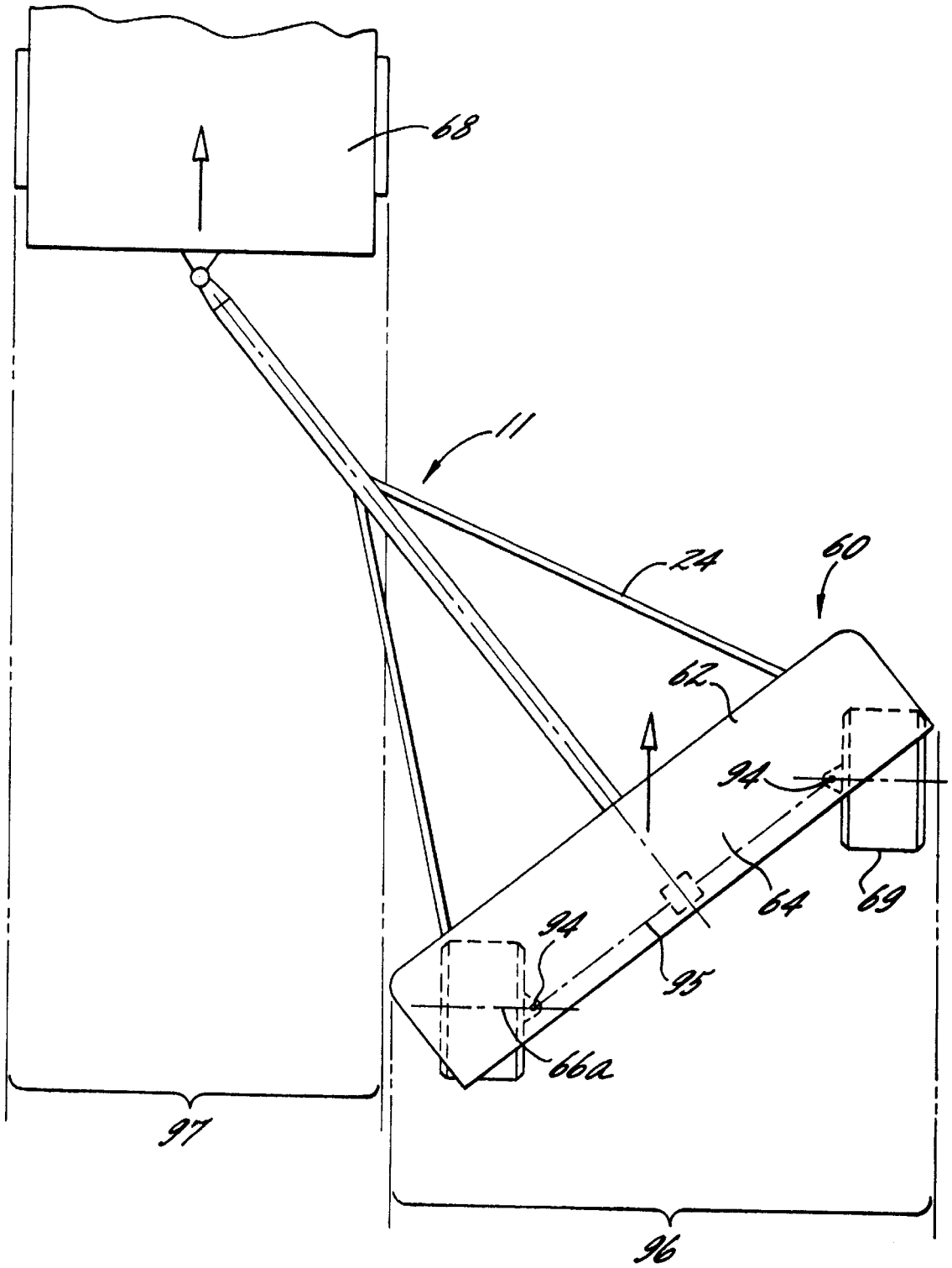
FIG. 18 A probe carrier with steering bogie assembly.

FIG. 18 shows a preferred embodiment in the operating diagram, in which the wheels 69 are fitted in steerable manner to the probe carrier body 64. As shown, e.g. an axle pivot steering can be provided, in which the wheel axles 66*a* are adjustable or steerable in the same direction about a vertical-axis kingpin 94. However, the same action can also be achieved in that as with a pivoted bogie steering the pole 11 is pivotably connected to the probe carrier body and e.g. the guide rods 24 can serve as steering rods, which are operated from the craft. The randomly mechanically or pneumatically operated steering system 95 of the represented axle pivot steering system is only shown in dot-dash line in FIG. 18.

This construction permits various uses. With the obliquity of the wheels shown in fixed form in FIG. 18 the probe carrier 62 assumes the laterally displaced inclined position behind the towing craft 68. The probe carrier is then inclined with respect to its main axial direction and consequently covers a search track 96, which is displaced or alongside the travel track 97 of the towing vehicle 68. This makes it possible to place the travel track on the already searched terrain, so as to minimize the risk for the towing craft. This construction operates particularly well with the wheel version according to FIG. 4, but can also be used with the crawler construction according to FIGS. 1 to 3, particularly through a steerable pole articulation to the frame.

In the case of an active steering of the wheels from the towing vehicle, the search track can be correspondingly set or, without the towing craft having to diverge from its track, e.g. in order to pass round a tree with the probe carrier, whilst it is also possible to have a right to left search track change on the part of the search vehicle.

The steerable construction of the bogie assembly on the probe carrier also permits a further, very advantageous use, namely the use of said probe carry vehicle as a component preceding the craft 68. This use is particularly appropriate for mined areas, e.g. for securing a vehicle column on a highway against mines. The rigid pole construction makes it possible to push the probe carrier in front of the craft. This is fundamentally possible with a fixed wheel setting, but requires great attentiveness on the part of the driver of the craft 68 and, in order to effectively perform pole steering, a very considerable road width, particularly in narrow curves, because the pushing craft must for this purpose extend out to a considerable extent, which could once again be dangerous. It is much easier if e.g. a co-driver using a separate steering system for the probe carrier bogie assembly controls it actively in front of the craft and optionally a wheel drive could be provided for the wheels 69, which can e.g. be constituted by a metal-free pneumatic drive. It would also be possible in this case to take relatively narrow bends.

Another improvement not represented in detail in the case of such narrow bends, e.g. in the case of serpentines around rock projections, would be to articulate the pole 11 horizontally by means of a link construction. However, it remains vertically rigid, so that it does not drag on the ground, but makes it possible in the steered and driven probe carrier to effect a serpentine before the following craft 68. For this purpose the pole could be made rigid again by inflating an air tube located in the open-link chain.

Particularly in the case of a towed probe carrier, the bogie assembly could have a mechanical forced servosteering, controlled by the angular position between the pole and the towing craft. This would make it possible, even in curves and despite the long pole to seek in track-true manner, i.e. obtain a complete coincidence between the travel track and the search track.

In order to produce a precise search protocol, i.e. a precise positional association of the signals detected by the probes with respect to the search area, it would e.g. be possible to provide optically operating path meters on the wheel 69

(pulse generators). Diverging from the otherwise basic principle of freedom from metals and magnetic materials on the part of the probe carrier, it would be possible to fit a small magnet to the wheel and which by means of the magnetic probes produces a path coding on the recording system, which is admittedly superimposed on the actual measurement, but as a result of the constant recurrence does not constitute interference or can be filtered out.

FIGS. 19 to 24 show a probe carrier, which is in particular constructed as a mine seeking device to travel in front of a mother vehicle or convoy. However, it can also be used for other purposes, by equipping it with other probes.

Figure 19:
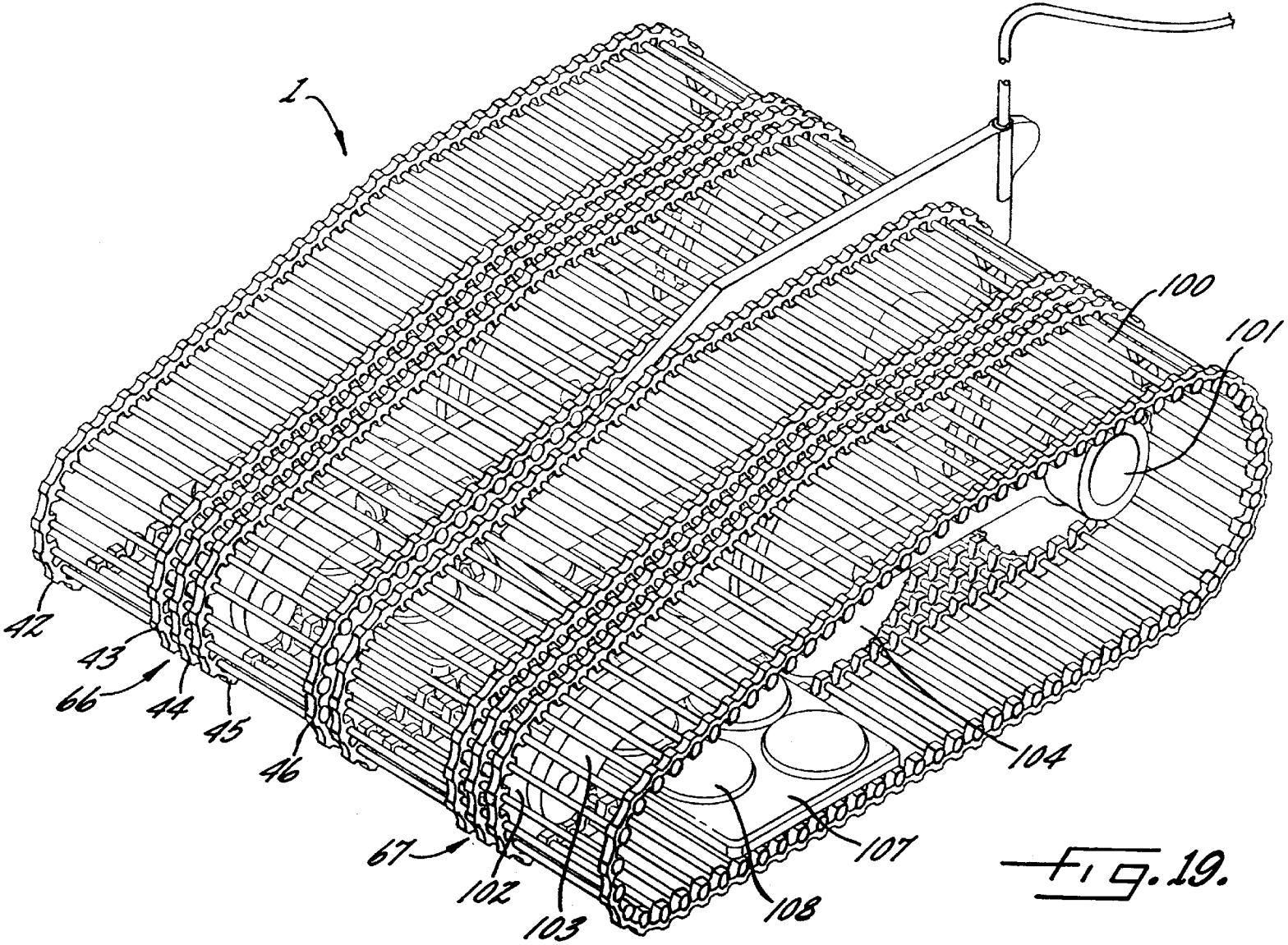
FIG. 19 A perspective view of a probe carrier with crawler bogie assembly.
Figure 21:
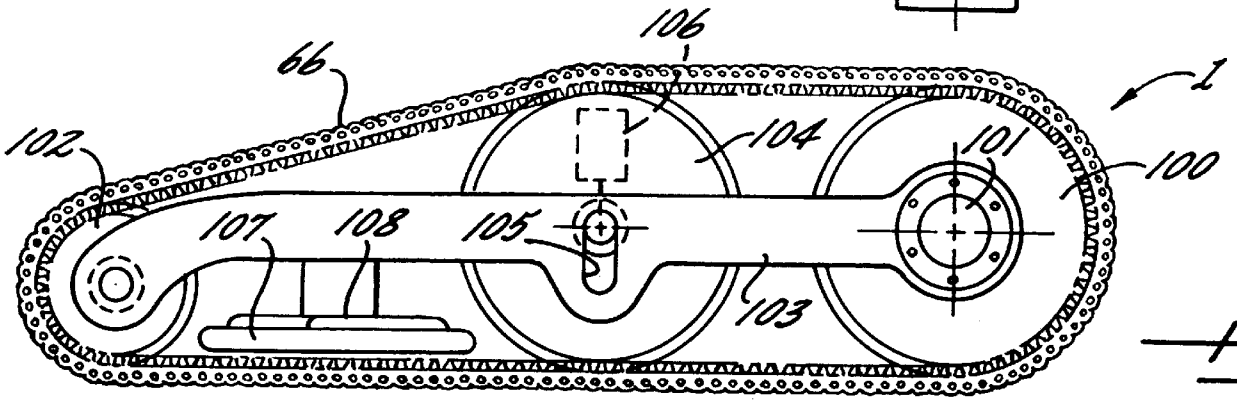
FIG. 21 A side view of this probe carrier.

FIG. 19 shows a probe carrier with crawlers or chain drives 66, 67 extending virtually over the entire width and length of the vehicle and which can be constructed in much the same way as described relative to FIGS. 1 to 3. Thus, they are crawlers assembled from extremely light and solid carbon fibre tubes, which extend between several toothed belt-like moving belts 42 to 46. The three central moving belts run over guide or drive wheels. A rear drive wheel 100 is toothed and can consequently transfer to the crawler the drive capacity produced by an electric, pneumatic or hydraulic hub motor 101. A front guide wheel 102, like the drive wheel 100, is fitted to the bogie assembly stringer 103, whilst a central guide wheel 104 is also guided on the stringer 103, but, as shown in FIG. 21, is vertically adjustable therein in a vertical guide 105 (e.g. an elongated hole) by using an adjusting device 106.

In the front area of the stringer, i.e. behind the front guide wheel 102, is provided a support plate 107 for eddy current probes 108, which within the crawlers run over the entire vehicle width.

Figure 20:
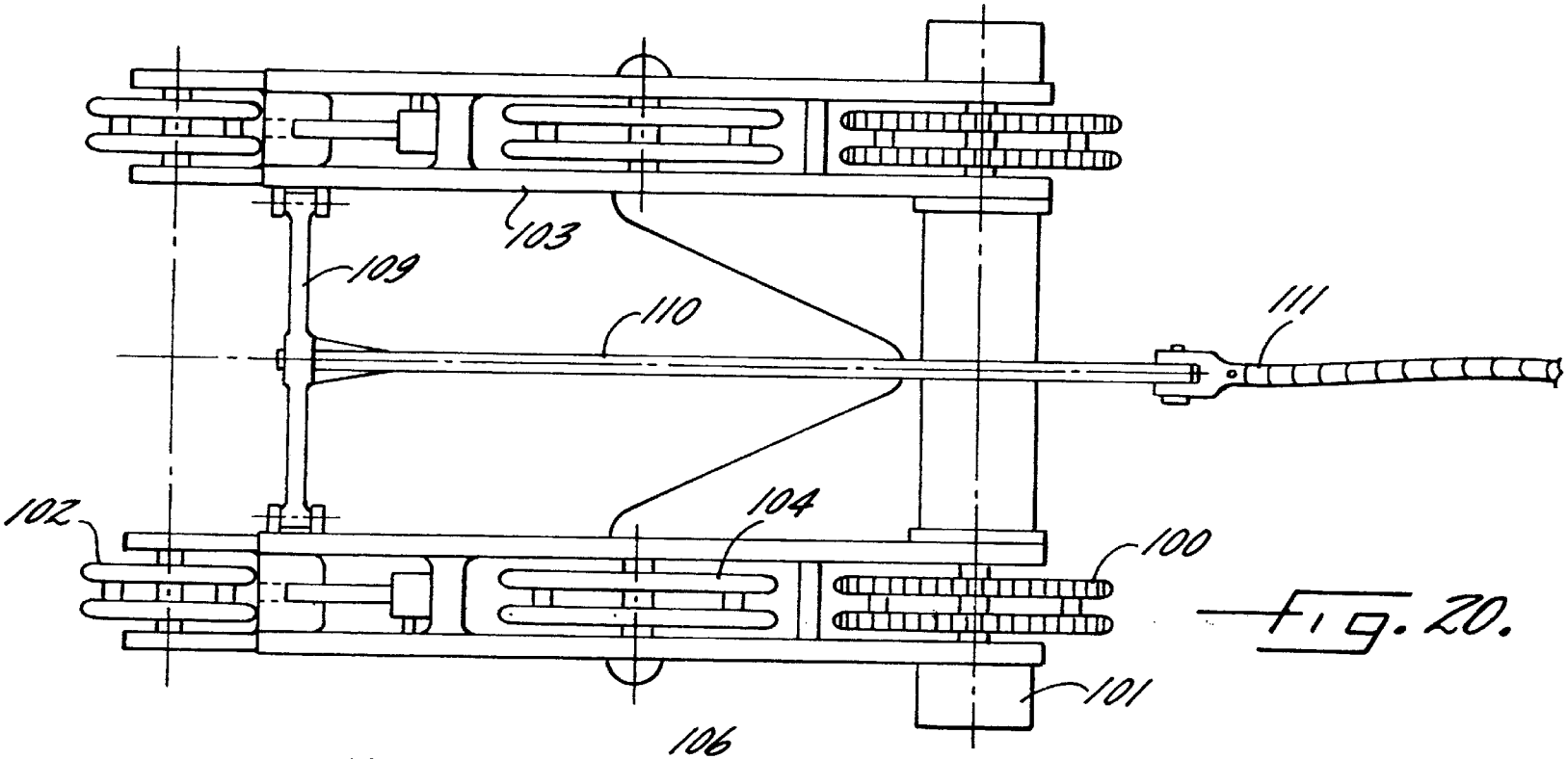
FIG. 20 A plan view of the probe carrier of FIG. 19.

FIG. 20 shows the bogie assembly without the crawlers. The two crawler stringers 103 are interconnected in the front area by means of a cross-linkage 109, on which engages a connecting rod 110, which is connected to the mother vehicle by a partly flexible chain 111. The already described partly flexible open-link chain, optionally reinforced by an internal compressed air hose, can serve as a thrust or pushing element, so that the probe carrier does not require its own drive, or can be flexible as a carrier for supply lines, e.g. compressed air or electric lines for the drive, etc., but as a result of the link construction for any random lateral mobility prevents said chain from dragging on the ground.

It is also possible for the probe carrier to be free and independently steered preceding the mother craft. For example the supply or control lines 112 could be fixed to a flexible mast projecting upwards from the probe carrier in the manner of an ocean fishing rod, which can be connected to a similar mast on the mother vehicle by supply lines 112 and otherwise forms a flexible connection not dragging on the ground.

Figure 22:
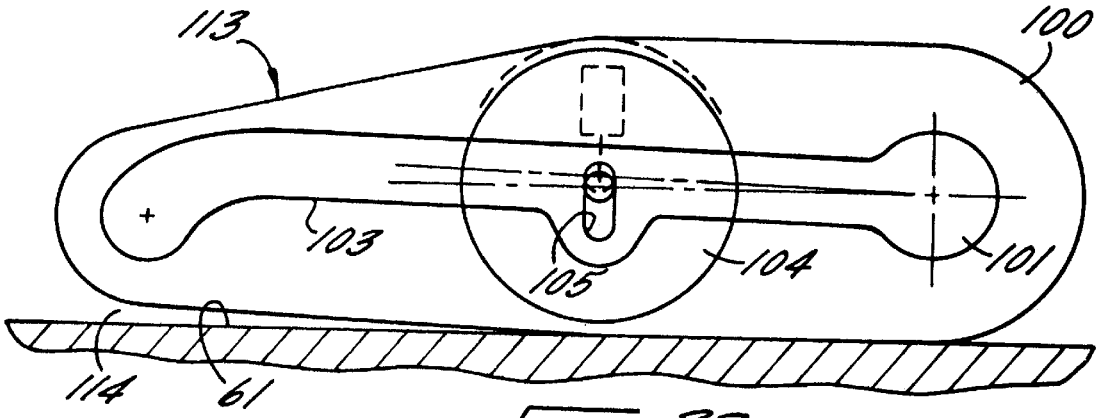
FIGS. 22–24 Said probe carrier in diagrammatic representation in three different working positions.
Figure 23:
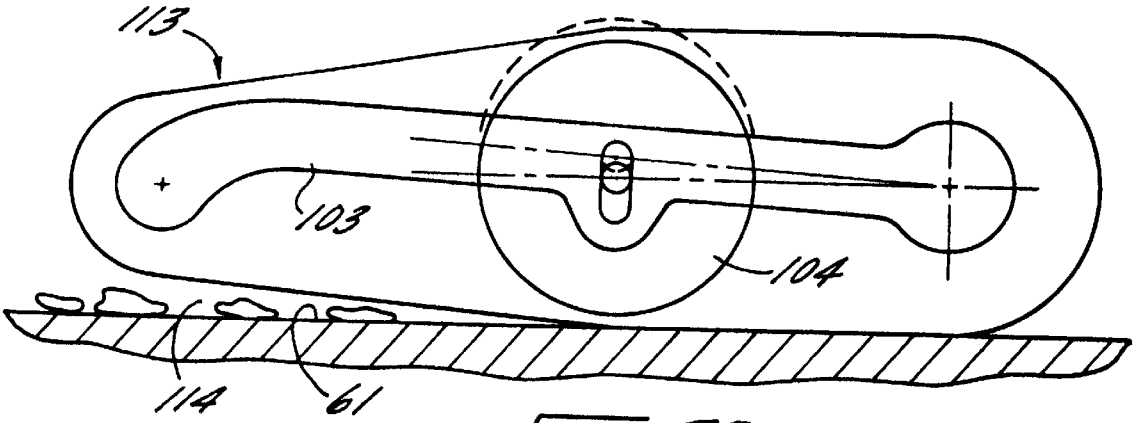
Figure 24:
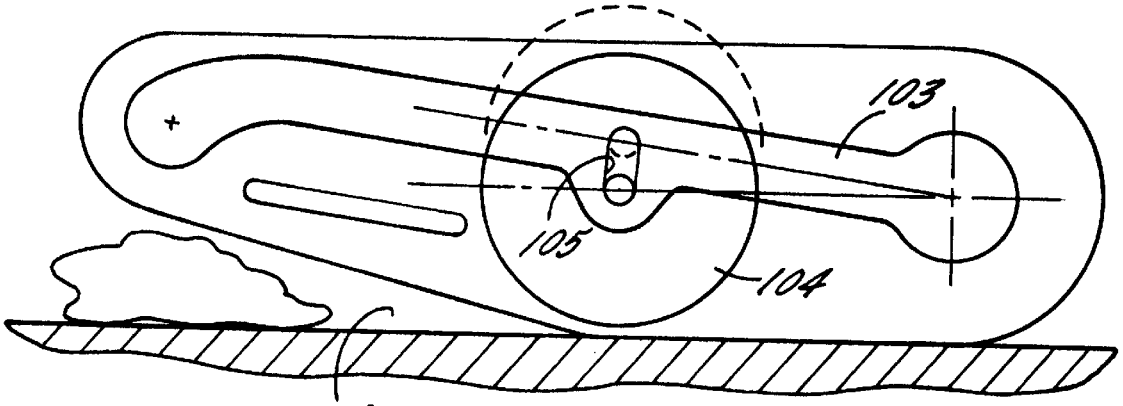

The operation is as follows. The probe carrier which e.g. has a width greater than the track width of the following crafts, is pushed by the following mother craft or travels automatically by means of drive motors 101. Through the extremely low weight and the crawler bearing surface taking up the entire probe carrier surface the ground pressure is very limited, so that it is scarcely to be feared that mines responding to the vehicles will be blown up by travelling over them. However, to ensure that this does not take place with very easily triggered mines, e.g. personnel mines, as shown in FIGS. 22 to 24, the probe carrier is so operated that its front portion 113 is raised somewhat from the ground 61, i.e. a gap 114 is formed and at least said portion is relieved. For this purpose the central guide wheel 104 is moved downwards by the adjusting device 106, which could e.g. also be a hand wheel, so that the entire stringer 103 is directed in upwardly sloping manner and consequently the front guide wheel 102 and the crawler part guided by it is raised from the ground. Driving stability is ensured, because the rear part of the vehicle with the driving wheel 100 and optionally a drive motor 101 is heavier. It can be seen that in this way the crawler vehicle is ideally adapted to circumstances. When travelling on level ground, e.g. on an asphalt road, the gap 114 can be very small (FIG. 22), whereas on a gravel road said angle is made somewhat larger and on passing over larger fragments or when travelling over open country the gap 114 can be made very large. This can either be preset in accordance with the road conditions or can be readjusted during travel e.g. by a pneumatic cylinder. The front, forwardly tapering portion 113, which as a result of said taper also gives a good view of the road from the following mother vehicle, can also rear up in front of an obstacle in the manner of a snake and creep over it and due to the fact that the front part is also rolled round by the crawler obstacles can be easily cleared. Each vehicle part which strikes against an obstacle is able to climb up the same.

The spacing of the probes 108 changes as a result of the raising up of the front part, so that it is appropriate for precise probing purposes to travel with the smallest gap 114 permitted by the circumstances.

As a result of the two crawlers 66, 67 driven by their own motors the probe carrier is steerable. A very effective brake mechanism should also be integrated. A system is also provided in which a probe output signal which could correspond to a mine immediately stops the probe carrier. As a result of the large bearing surface and the low total weight of the probe carrier largely made from high-strength, non-metallic materials an immediate stopping is possible, so that prior to the first ground contact in the vicinity of the wheel 104 the probe carrier stops if a mine is detected. In the following mother craft can be provided a simpler, but more gently operating brake mechanism or braking can be detected optically or by a signal from the driver, so that he also brakes in good time. Therefore the flexible connection either via the open-link chain 111 or a cable connection 112 is important, so that a certain clearance always exists between the leading probe carrier and the mother vehicle, so as to allow stopping in good time. A braking action occurring as suddenly as in the probe carrier, would expose the personnel in the mother vehicle to considerable delays.

It is also possible to steer the probe carrier, which is in any case steered by the mother vehicle, by wireless remote control. However, in this case it must carry its own energy source for its drive.

It is also important that all the mechanical parts, which may not be manufacturable in metal-free manner (electric motors, etc.), should be located in the rear part of the probe carrier, so that the front, probe-carrying section does not suffer interference. It is possible to fit to the connecting rod 110 optionally constructed as a vertical strut (cf. FIG. 19) a television camera, which is directed onto the ground in front of the probe carrier and facilitates steering for the driver or co-driver in the mother craft.

When using pneumatic motors as the drive and/or a pneumatic braking system, the air hose in the open-link chain 111 and which stiffens said chain to the connecting rod, could be directly connected to the braking system, so that simultaneously with the braking or using said compressed air for the brake the air hose is emptied and consequently the chain made flexible again, so that the necessary run-out reserve for the mother vehicle is also possible when the probe carrier is subject to braking in pushing operation.

We claim:

1. Probe carrying vehicle comprising at least one probe carrier, the probe carrier being movable relative to a search area and the probe carrier being provided with spacing means for receiving at least one probe for ground and foreign matter detection in the search area and for maintaining a spacing between the probe and the ground so as to permit a translatory movement of the probe carrier in a movement direction over the search area, the probe carrying vehicle further comprising a long pole rigidly connected to the probe carrier at least with respect to a horizontal axis and the pole having remote from the probe carrier coupling means for flexible coupling of the pole to a pulling or pushing craft.

2. Probe carrying vehicle according to claim 1, wherein the pole has a considerable length compared with the amplitude of the ground unevenesses to be overcome by the probe carrying vehicle.

3. Probe carrying vehicle according to claim 1, wherein the pole, based on a straight connecting line between the coupling means and the probe carrier, has a generally upwardly diverging form.

4. Probe carrying vehicle according to claim 1, wherein the pole is a framework construction with at least three non-coplaner rods connected on one end to the coupling means and on the other end to the probe carrier.

5. Probe carrying vehicle according to claim 4, wherein the rods of the framework construction define the edges of a pyramid with the coupling means disposed at the tip side of the pyramid and the probe carrier disposed at the bottom side of the pyramid.

6. Probe carrying vehicle according to claim 1, wherein the pole comprises at least two detachably interconnected pole segments.

7. Probe carrying vehicle according to claim 6, wherein two successive pole segments are connected by means of a swivel joint.

8. Probe carrying vehicle according to claim 6, wherein a pole segment has frontal end plates, the frontal end plates being interconnected by means of at least three non-coplaner rods.

9. Probe carrying vehicle according to claim 1, wherein the coupling means have a holder connected to the pole, the holder comprising a connecting element rotatably mounted about a substantially vertical rotation axis for connecting the holder to the craft.

10. Probe carrying vehicle according to claim 1, wherein at least one element of the group consisting of the pole and the probe carrier is essentially made from bending-stiff material which is at least one of the group consisting of electrically non-conductive and non-magnetizable material.

11. Probe carrying vehicle according to claim 1, wherein at least one element of the group consisting of the probe carrier and the pole is assembled from detachably interconnected frame elements.

12. Probe carrying vehicle according to claim 1, wherein the probe is at least one element of the group consisting of an eddy current probe and a magnetic field probe.

13. Probe carrying vehicle according to claim 1, wherein there is provided at least one magnetic field probe and at least one eddy current probe and wherein there are provided switchover means for permitting an alternating operation of the eddy current probe and the magnetic field probe.

14. Probe carrying vehicle according to claim 1, wherein the spacing means of the probe carrier comprises at least one receiving sleeve for the probe, the probe being held in removable manner in the receiving sleeve.

15. Probe carrying vehicle according to claim 1, wherein the probe carrier comprises several probes being juxtaposed transversly to the movement direction.

16. Probe carrying vehicle according to claim 1, wherein the spacing means comprise a bogie assembly, the bogie assembly comprising at least one of the group consisting of (a) at least one revolving chain drive guided by guidance means and (b) several parallel moving belts made from elastically resilient material, which are interconnected by bending-elastic transverse connectors positioned transversely to the movement direction.

17. Probe carrying vehicle according to claim 16, wherein the moving belts and the transverse connectors are essentially made from electrically non-conductive material.

18. Probe carrying vehicle according to claim 16, wherein the guidance means comprise guide wheels for the lateral guidance of the chain drive, a guide wheel having at least one single wheel engaging with its circumferential area in substantially lateral clearance-free manner in a longitudinal recess formed in the chain drive.

19. Probe carrying vehicle according to claim 18, wherein the guide wheels comprise at least one bottom-side guide wheel engaging substantially centrally on the chain drive.

20. Probe carrying vehicle according to claim 18, wherein there are provided at least two bottom-side guide wheels positioned on a bogie assembly rocker, the bogie assembly rocker being pivotably mounted about a pivot pin connected to the probe carrier and running transversly to the movement direction.

21. Probe carrying vehicle according to claim 16, wherein the chain drive defines a chain interior and wherein at least one probe is located completely within the chain interior.

22. Probe carrying vehicle according to claim 1, wherein the spacing means comprise a bogie assembly with at least two wheels.

23. Probe carrying vehicle according to claim 22, wherein the wheels comprise tires drawn onto a rim in the manner of car tires, wherein at least one element of the group consisting of the tires and the rim is completely metal free.

24. Probe carrying vehicle according to claim 23, wherein the tires are constructed as pneumatic tires without a compressed air filling.

25. Probe carrying vehicle according to claim 22, wherein the probe carrier comprises covers partly covering the wheels on the circumference.

26. Probe carrying vehicle according to claim 25, wherein the covers cover the wheels also on the outside in the manner of mud guards and wherein the covers are also adapted to receive probes.

27. Probe carrying vehicle according to claim 1, wherein the probe carrier is towed by the craft.

28. Probe carrying vehicle according to claim 1, wherein the probe carrier is provided so as to precede the craft.

29. Probe carrying vehicle according to claim 1, wherein the pole is articulated in a horizontal plane, but rigid in the vertical plane.

30. Probe carrying vehicle according to claim 29, wherein the pole comprises an open-link chain.

31. Probe carrying vehicle according to claim 30, wherein the open-link chain contains operable stiffening means comprising an inflatable hose.

32. Probe carrying vehicle according to claim 1, wherein the probe carrier has its own drive operable from the craft.

33. Probe carrying vehicle according to claim 1, wherein the probe carrier is designed for searching a water-covered bed.

34. Probe carrying vehicle according to claim 33, wherein the probe carrier is designed for towing behind a watercraft.

35. Probe carrying vehicle according to claim 34, wherein the pole comprises a parallelgram guide to allow parallel displacement of the probe carrier in different depths below the watercraft.

36. Probe carrying vehicle according to claim 34, wherein on the side of the watercraft the pole engages on a base element fixable to the watercraft.

37. Probe carrying vehicle according to claim 36, wherein the base element is floatable.

38. Probe carrying vehicle according to claim 36, wherein the base element contains control, measuring and supply means for the probe carrier.

39. Probe carrying vehicle according to claim 33, wherein the probe carrier contains a floating body adapted to be flooded and blown out.

40. Probe carrying vehicle according to claim 33, wherein the probe carrier comprises a hydrodynamic depth control, which is controllable for spacing the probe carrier from the ground as a function of a measurement of the water depth and the depth of the probe carrier below the water surface.

41. Probe carrying vehicle according to claim 33, wherein an angle measuring member engaging on the pole is provided for measuring the depth of the probe carrier under the watercraft.

42. Probe carrying vehicle according to claim 16, wherein the bogie assembly has a front section being designed in a manner to be one of the group consisting of relievable and raisable with respect to the ground.

43. Probe carrying vehicle according to claim 42, wherein the probe carrying vehicle comprises ramps operatively connected to the probe carrier, the ramps incorporating the probes, the ramps having guide wheels and wherein central guide wheels of the ramps are vertically adjustable.

44. Probe carrying vehicle according to claim 1, wherein the probe carrier comprises a brake mechanism which responds to probe signals and initiates an immediate braking of the probe carrier in the case of a danger signal prior to travelling over a danger point and as a result of a non-rigid connection to the craft following the probe carrier said craft is given a greater braking path.

45. A probe carrying vehicle adapted to be moved over the ground surface for the purpose of detecting ground and foreign matter in a search area, and comprising a probe carrier having a supporting frame which is adapted to be moved over the ground surface, at least one probe for ground and foreign matter detection mounted to the supporting frame of the probe carrier and so as to maintain a spacing between the probe and the ground, and an elongate pole rigidly connected to the supporting frame of the probe carrier and extending therefrom in a substantially horizontal direction, said pole having coupling means at the end thereof remote from the probe carrier for coupling the vehicle to a pulling or pushing craft, and said pole having a length sufficient to render the tilt angle of the probe carrier substantially independent of the ground unevenness across which the probe carrier is moved.

46. The probe carrying vehicle as defined in claim 45 wherein said pole has a length of at least about 4 meters.

47. Probe carrying vehicle comprising at least one probe carrier, the probe carrier being movable relative to a search area and the probe carrier being provided with spacing means for receiving at least one probe for ground and foreign matter detection in the search area and for maintaining a spacing between the probe and the ground so as to permit a translatory movement of the probe carrier in a movement direction over the search area, the probe carrying vehicle further comprising a long pole rigidly connected to the probe carrier at least with respect to a horizontal axis and the pole having remote from the probe carrier coupling means for flexible coupling of the pole to a pulling or pushing craft, said probe carrier comprising means for the detachable connection to further probe carriers with or without their own spacing means.

48. Probe carrying vehicle comprising at least one probe carrier, the probe carrier being movable relative to a search area and the probe carrier being provided with spacing means for receiving at least one probe for ground and foreign matter detection in the search area and for maintaining a spacing between the probe and the ground so as to permit a translatory movement of the probe carrier in a movement direction over the search area, the probe carrying vehicle further comprising a long pole rigidly connected to the probe carrier at least with respect to a horizontal axis and the pole having remote from the probe carrier coupling means for flexible coupling of the pole to a pulling or pushing craft, said probe carrier having a sledge or tub-like underside adapted to form a sliding mechanism for the probe carrying vehicle.

49. Probe carrying vehicle comprising at least one probe carrier, the probe carrier being movable relative to a search area and the probe carrier being provided with spacing means for receiving at least one probe for ground and foreign matter detection in the search area and for maintaining a spacing between the probe and the ground so as to permit a translatory movement of the probe carrier in a movement direction over the search area, the probe carrying vehicle further comprising a long pole rigidly connected to the probe carrier at least with respect to a horizontal axis and the pole having remote from the probe carrier coupling means for flexible coupling of the pole to a pulling or pushing craft, said probe carrier comprising at least one bogie assembly which is supported by wheels and wherein the travel direction of the wheels and thus the bogie assembly is adjustable.

50. Probe carrying vehicle comprising at least one probe carrier, the probe carrier being movable relative to a search area and the probe carrier being provided with spacing means for receiving at least one probe for ground and foreign matter detection in the search area and for maintaining a spacing between the probe and the ground so as to permit a translatory movement of the probe carrier in a movement direction over the search area, the probe carrying vehicle further comprising a long pole rigidly connected to the probe carrier at least with respect to a horizontal axis and the pole having remote from the probe carrier coupling means for flexible coupling of the pole to a pulling or pushing craft, and wherein there is provided steering means for steering the travel direction of the probe carrier, the steering means being operable from the craft.

51. Probe carrying vehicle comprising at least one probe carrier, the probe carrier being movable relative to a search area and the probe carrier being provided with spacing means for receiving at least one probe for ground and foreign matter detection in the search area and for maintaining a spacing between the probe and the ground so as to permit a translatory movement of the probe carrier in a movement direction over the search area, the probe carrying vehicle further comprising a long pole rigidly connected to the probe carrier at least with respect to a horizontal axis and the pole having remote from the probe carrier coupling means for flexible coupling of the pole to a pulling or pushing craft, and wherein the pole has a length corresponding to 1.5 to 4 times the horizontal dimensions of the probe carrier.

* * * * *